US008339045B2

(12) United States Patent
Li et al.

(10) Patent No.: US 8,339,045 B2
(45) Date of Patent: Dec. 25, 2012

(54) LIGHTING STRUCTURE

(75) Inventors: Chih Chun Li, Taipei (TW); Cheng Hsiu Wu, Taipei (TW)

(73) Assignee: Feton Limited, Taipei (TW)

( * ) Notice: Subject to any disclaimer, the term of this patent is extended or adjusted under 35 U.S.C. 154(b) by 261 days.

(21) Appl. No.: 12/805,493

(22) Filed: Aug. 3, 2010

(65) Prior Publication Data

US 2011/0062897 A1 Mar. 17, 2011

(30) Foreign Application Priority Data

Sep. 11, 2009 (TW) ..... 98216818 U

(51) Int. Cl.
*H01J 13/46* (2006.01)

(52) U.S. Cl. ..... 315/32; 315/55; 315/362

(58) Field of Classification Search ..... 315/32–33, 315/51, 55, 307, 360, 362; 362/127–133
See application file for complete search history.

(56) References Cited

U.S. PATENT DOCUMENTS 4,034,552 A * 7/1977 Davidson ..... 368/280
6,525,487 B2 * 2/2003 Wei ..... 315/200 A
2004/0085752 A1 * 5/2004 Fuwausa et al. ..... 362/84
2011/0194276 A1 * 8/2011 Au ..... 362/104
2011/0255269 A1 * 10/2011 Liao ..... 362/103

* cited by examiner

*Primary Examiner* — James H Cho

(74) *Attorney, Agent, or Firm* — Bacon & Thomas, PLLC

(57) ABSTRACT

The lighting structure of the present invention can be installed in a cupboard, a wardrobe, a filing cabinet or another structural object requiring an auxiliary light source. The lighting structure comprises: a body provided with a lamp and an electrical circuit; and a base adapted to be installed on the structural object and joined with the body. The electrical circuit comprises a vibration sensing element, a control element and an electric power supplying portion. The electric power supplying portion is configured to supply electric power necessary for operation of the electrical circuit. When the lighting structure is vibrated, the vibration sensing element outputs an electrical signal to the control element so that the control element chooses to turn on or off the lamp correspondingly.

26 Claims, 32 Drawing Sheets

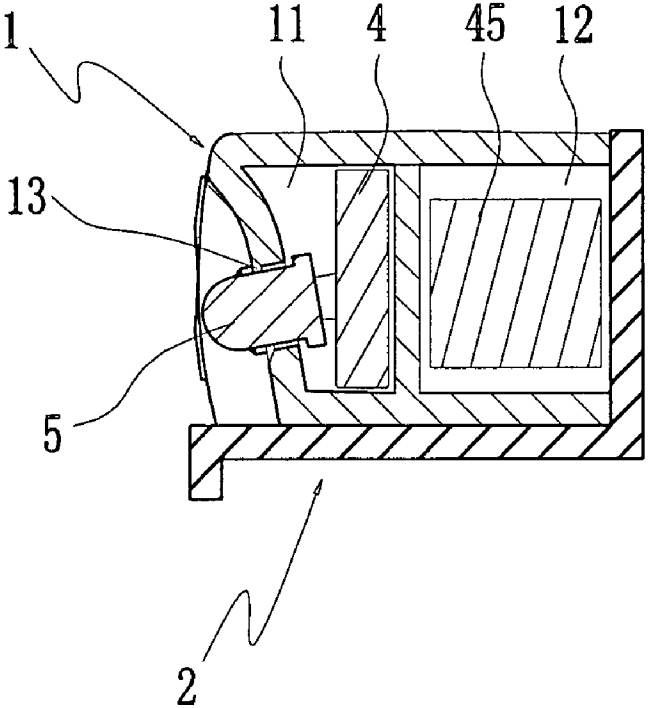
Fig. 5 I-I

LIGHTING STRUCTURE

BACKGROUND OF THE INVENTION

1. Technical Field

The present invention relates to lighting structures, and more particularly, to a lighting structure installed in cabinets or in various structural objects requiring lighting.

2. Description of Related Art

The present invention relates to lighting structures, and more particularly, to a lighting structure installed in cabinets or in various structural objects requiring lighting.

BRIEF SUMMARY OF THE INVENTION

The present invention relates to lighting structures, and a primary objective thereof is to provide a lighting structure which can deliver a lighting effect by using a vibration sensing element to turn on a light emitting element automatically, and can reduce power consumption of a lamp structure and improve convenience to use.

A secondary objective of the lamp structure of the present invention is to provide a lamp structure for lighting which can use batteries as an electric power source to improve convenience in installing the lamp structure.

Yet a further objective of the lamp structure of the present invention is to allow the lighting structure to be installed on various forms of structural objects by means of an associated base to improve applicability of the lamp structure.

In order for those skilled in the art to further understand the objectives, features and effects of the present invention, a detailed description will be made on embodiments thereof with reference to the attached drawings hereinafter.

BRIEF DESCRIPTION OF THE SEVERAL VIEWS OF THE DRAWINGS

The invention as well as a preferred mode of use and advantages thereof will be best understood by referring to the following detailed description of illustrative embodiments in conjunction with the accompanying drawings, wherein:

FIG. 5 is a cross-sectional view showing a cross-section along line I-I of FIG. 3 of the present invention;

DETAILED DESCRIPTION OF THE INVENTION

For clearer understanding of the present invention, embodiments will be described to illustrate the present invention hereinafter.

Figure 1:
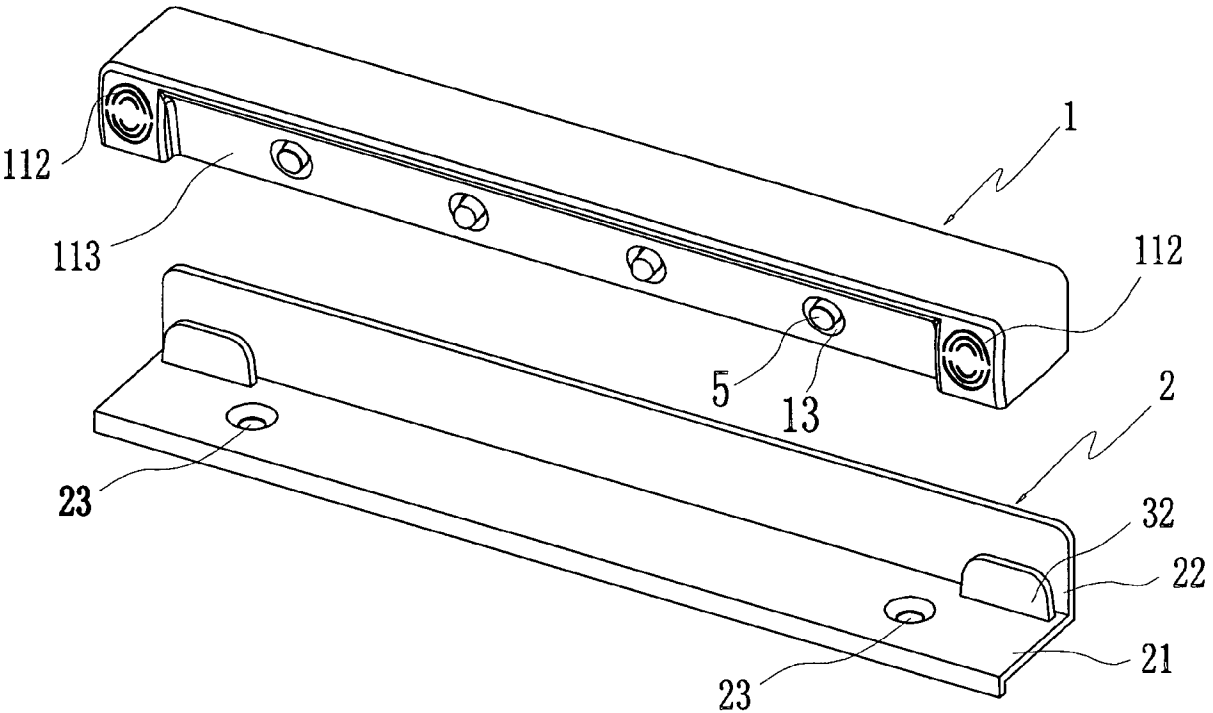
FIG. 1 is a perspective view showing an exploded status of a lighting structure of the present invention.
Figure 2:
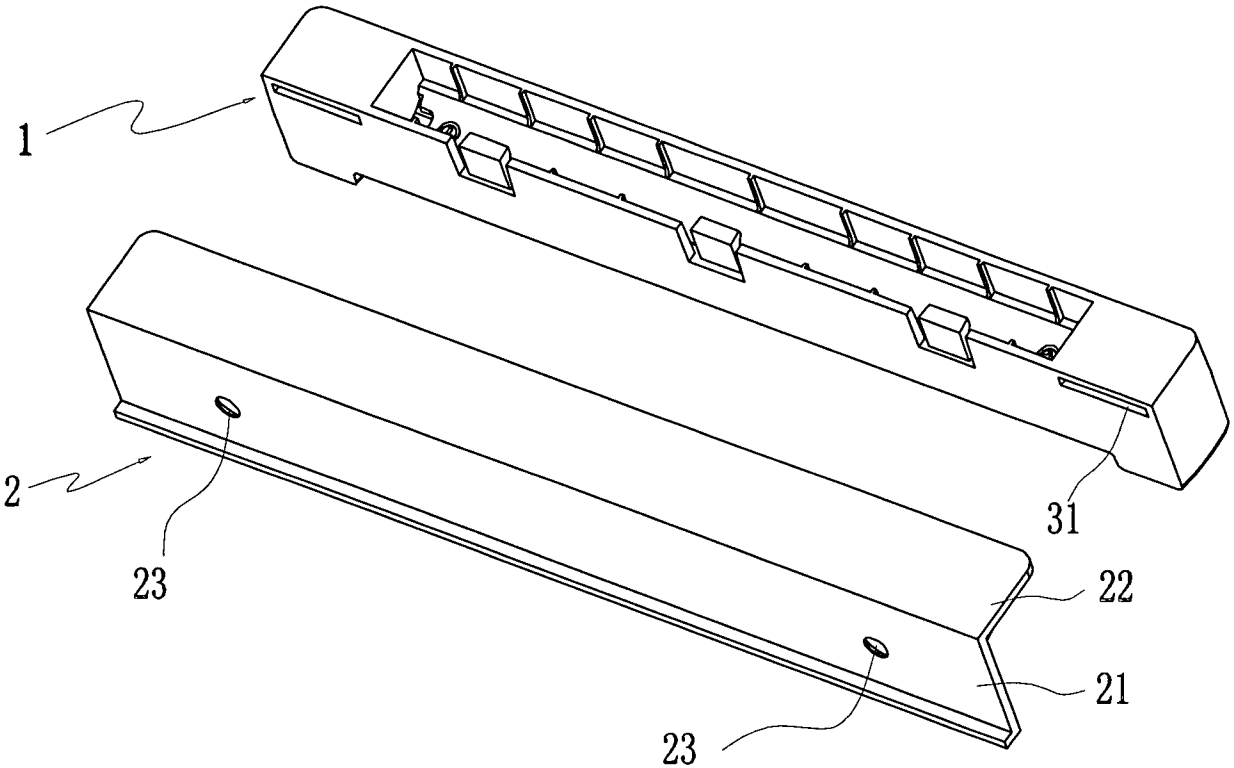
FIG. 2 is a perspective view showing the exploded status of the lighting structure of the present invention from another viewing angle.
Figure 3:
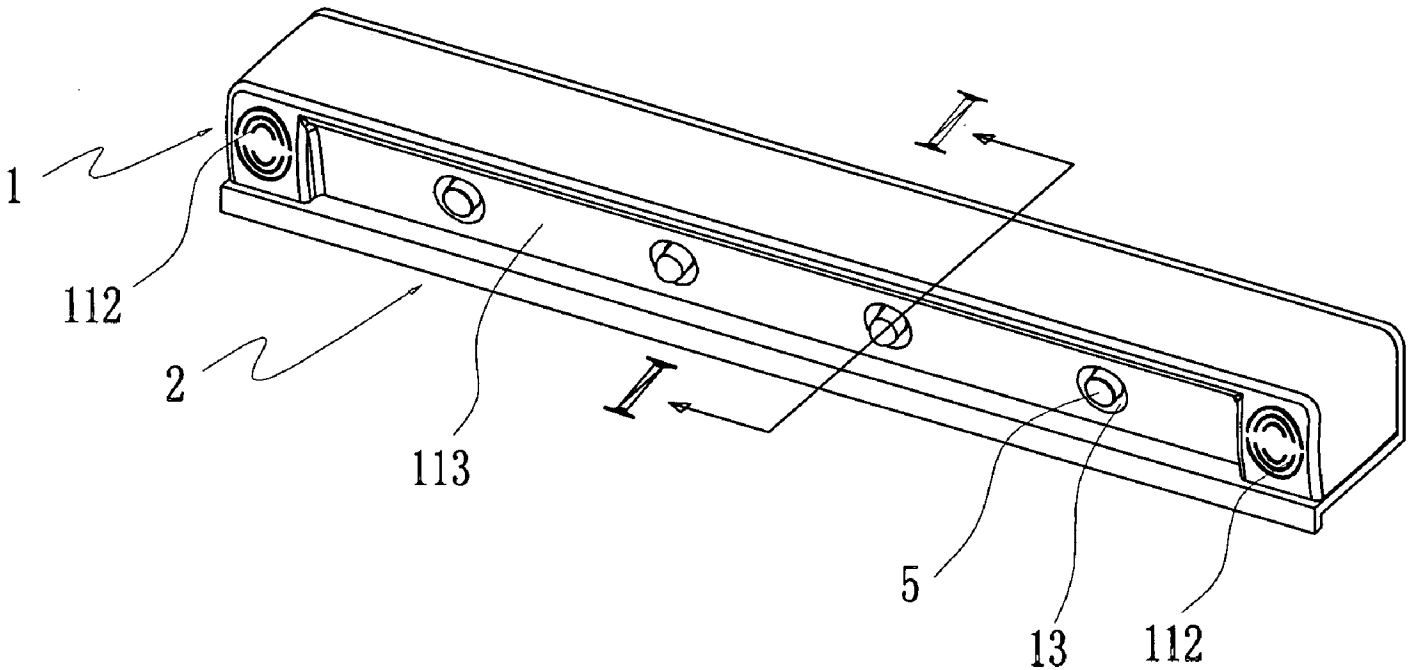
FIG. 3 is a perspective view showing an assembled status of the lighting structure of the present invention.

The lighting structure of the present invention is a light source device that can be installed in wardrobes, drawers, cupboards or any structural objects, and can be used as an auxiliary light source. FIG. 1 is a perspective view showing an exploded status of the lighting structure of the present invention. FIG. 2 is a perspective view showing the exploded status of the lighting structure of the present invention from another viewing angle. FIG. 3 is a perspective view showing an assembled status of the lighting structure of the present invention. Referring to FIG. 1, FIG. 2 and FIG. 3, the lighting structure comprises a body 1, a base 2, an electrical circuit (not shown) and at least one lamp 5. The body 1 and the base 2 are joined together through engagement of a first engagement portion 31 in the body 1 and a second engagement portion 32 in the base 2. The electrical circuit is disposed in the body 1 and controls the lamp 5 to turn on and turn off. The lamp 5 is disposed in the body 1 and partially exposed from an outer end surface of the body 1. Therefore, the body 1 can be disposed in a cabinet or on any structural object by means of the base 2, and when the electrical circuit in the body 1 is supplied properly with electric power, the lighting structure can be used for lighting.

Figure 4:
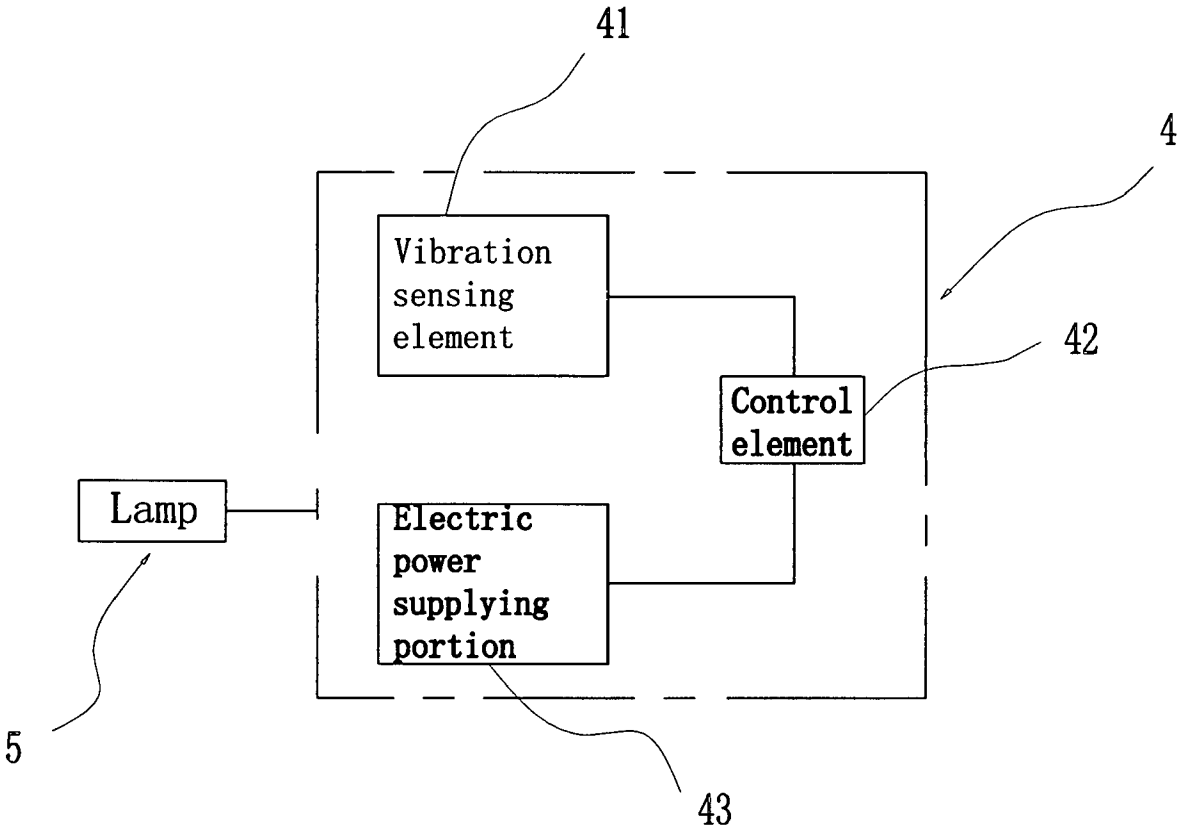
FIG. 4 is a schematic view showing an electrical circuit of the lighting structure of the present invention.

FIG. 4 is a schematic view showing the electrical circuit of the lighting structure of the present invention. Referring to FIG. 4, the aforesaid electrical circuit 4 may comprise a vibration sensing element 41, a control element 42 and an electric power supplying portion 43. When the body 1 is vibrated, the vibration sensing element 41 inside the body 1 can output a corresponding electrical signal to the control element 42. After receiving the electrical signal of the vibration sensing element 41, the control element 42 can choose to turn on or turn off the lamp 5 of the electrical circuit 4 correspondingly. The electric power supplying portion 43 is configured to supply electric power necessary for operation of the electrical circuit 4. In an embodiment, when the lamp 5 of the electrical circuit 4 is in the turn-off status and the vibration sensing element 41 is vibrated to output the electrical signal, the control element 42 will choose to turn on the lamp 5 correspondingly; and when the lamp 5 of the electrical circuit 4 is in the turn-on status and the vibration sensing element 41 is vibrated to output the electrical signal, the control element 42 will choose to turn off the lamp 5 correspondingly.

Additionally, in another embodiment, the control element 42 may further provide a logic control function so that when receiving the electrical signal from the vibration sensing element 41, the control element 42 chooses to turn on the lamp 5 correspondingly and, after a time preset in the control element 42 has elapsed, chooses to turn off the lamp 5.

The aforesaid electric power supplying portion 43, in an embodiment, may comprise a device that can be externally connected to a power source. Additionally, in another embodiment, the aforesaid electric power supplying portion 43 may comprise a device having a built-in power source, and the built-in power source may be a battery, a secondary battery or a electric power generating device, a electric generator, a fuel cell, or a solar cell.

FIG. 5 is a cross-sectional view showing a cross-section along line I-I of FIG. 3 according to the present invention. Referring to FIGS. 1, 2, 3 and 5, in the aforesaid lighting structure, the body 1 is a cuboid structure and comprises a first space 11 and a second space 12 therein. The first space 11 is adapted to accommodate the electrical circuit 4, and at least one lamp hole 13 extending through the body 1 from the first space 11 outwards is formed. The lamp hole 13 corresponds to the aforesaid lamp 5 so that light of the lamp 5 can be emitted through the corresponding lamp hole 13. The second space 12 forms an electric power input portion that can supply electric power necessary for the electrical circuit 4. The base 2 is formed as an L-shaped body whose length corresponds to that of the body 1, and comprises a base plate 21 and a back plate 22. The base plate 21 has a rear end extending upwards to form the back plate 22, and the back plate 22 corresponds to a back surface of the body 1.

In the embodiment of the lighting structure described above, the second space 12 is further provided with a battery holder, which can accommodate a plurality of batteries 45 and is electrically connected to the electrical circuit 4 to supply electric power necessary for the electrical circuit 4. Furthermore, an opening that extends through the body 1 from the second space 12 outwards is formed for assembling or disassembling these batteries 45. Furthermore, the aforesaid back plate 22 corresponds to the back surface of the body 1 and can cover the opening of the second space 12 of the body 1 so that, after the body 1 and the base 2 are joined together, the batteries 45 disposed in the second space 12 of the body 1 can be covered by the back plate 22.

In the aforesaid second space 12 there is formed an electric power input portion to be connected to an external electric power source, for example, the utility power, a power supply and the like, so as to supply electric power necessary for the electrical circuit 4.

In the base 2 of the lighting structure of the present invention described above, the base plate 21 comprises at least one through hole 23, which is formed by extending downwards from an upper surface of the base plate 21 and is adapted for a screw to be inserted therethrough. Thus, the base 2 is fixedly disposed on the cabinet by means of the screw 24. For example, if the cabinet is a piece of wooden furniture, then the base 2 can be fixedly disposed on the cabinet by screwing a wood screw through the through hole 23 into the cabinet.

In the lighting structure of the present invention described above, the first engagement portion 31 is fixedly disposed in the body 1 and the second engagement portion 32 is disposed in the base 2 so that the body 1 and the base 2 can be joined together through engagement of the first engagement portion 31 and the second engagement portion 32. Specifically, the first engagement portion 31 may comprise at least one concave hole which is a concave structure formed by extending upwards from the bottom of the body 1, and the second engagement portion 32 comprises a convex plate corresponding to the concave hole of the first engagement portion 31, which is a convex structure formed by extending upwards from the base plate 21 of the base 2. Thereby, the concave hole of the first engagement portion 31 and the convex plate of the second engagement portion 32 can engage with and disengage from each other so that the body 1 and the base 2 can be joined to or separated from each other by means of the concave hole and the convex plate.

Figure 6A:
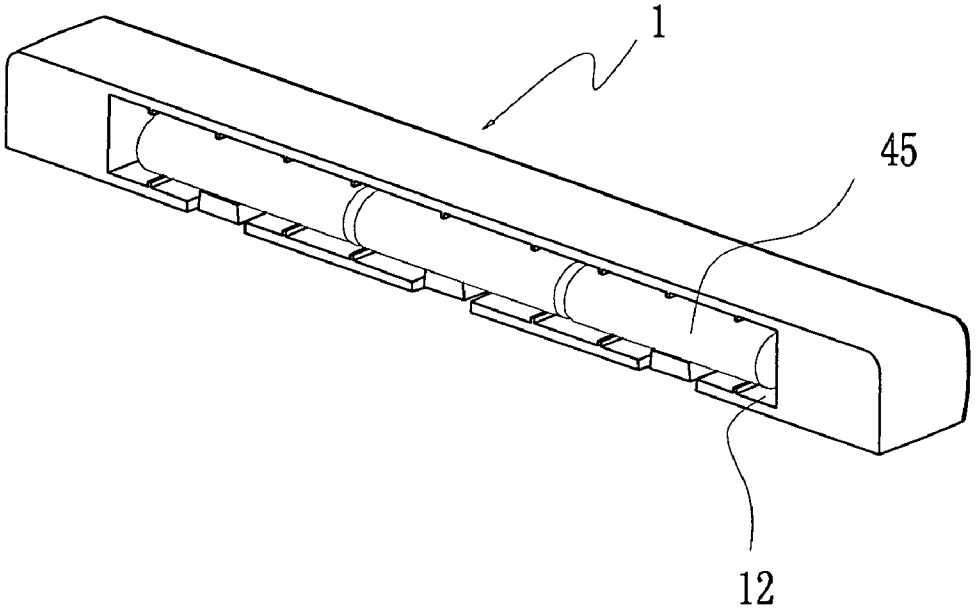
FIG. 6A is a perspective view showing a battery-installed status of the lighting structure of the present invention.
Figure 6B:
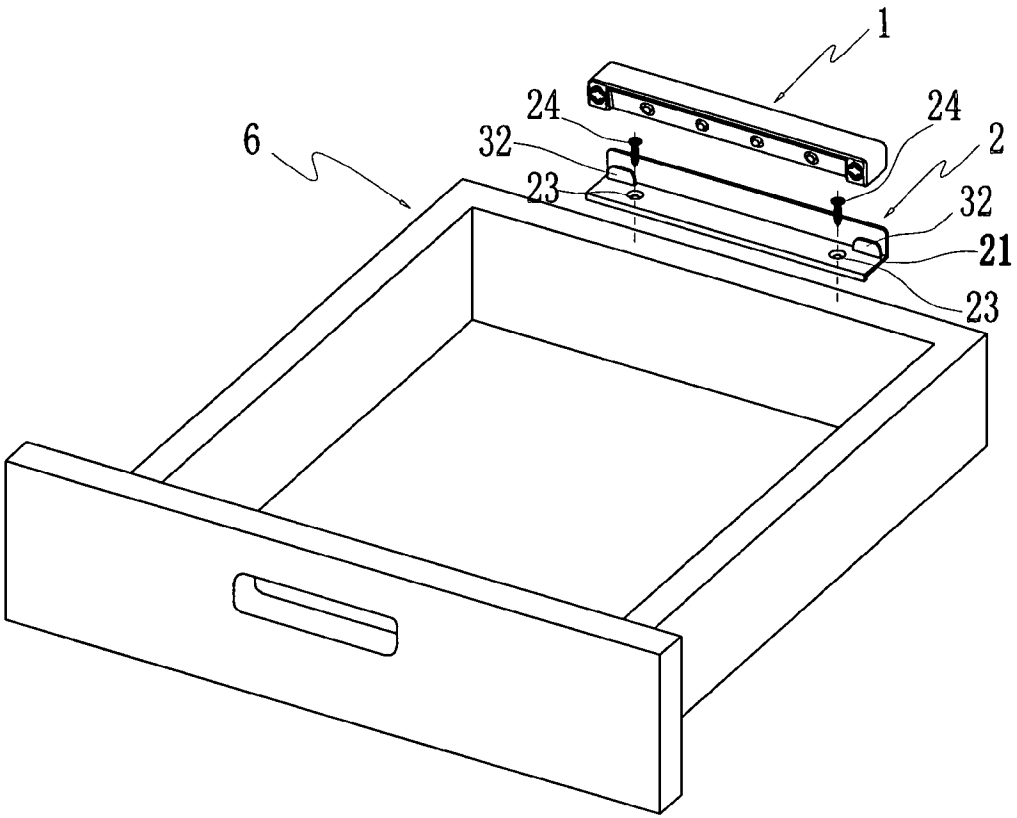
FIG. 6B is a perspective view showing a status before a base is installed according to an embodiment in which the lighting structure of the present invention is used.
Figure 6C:
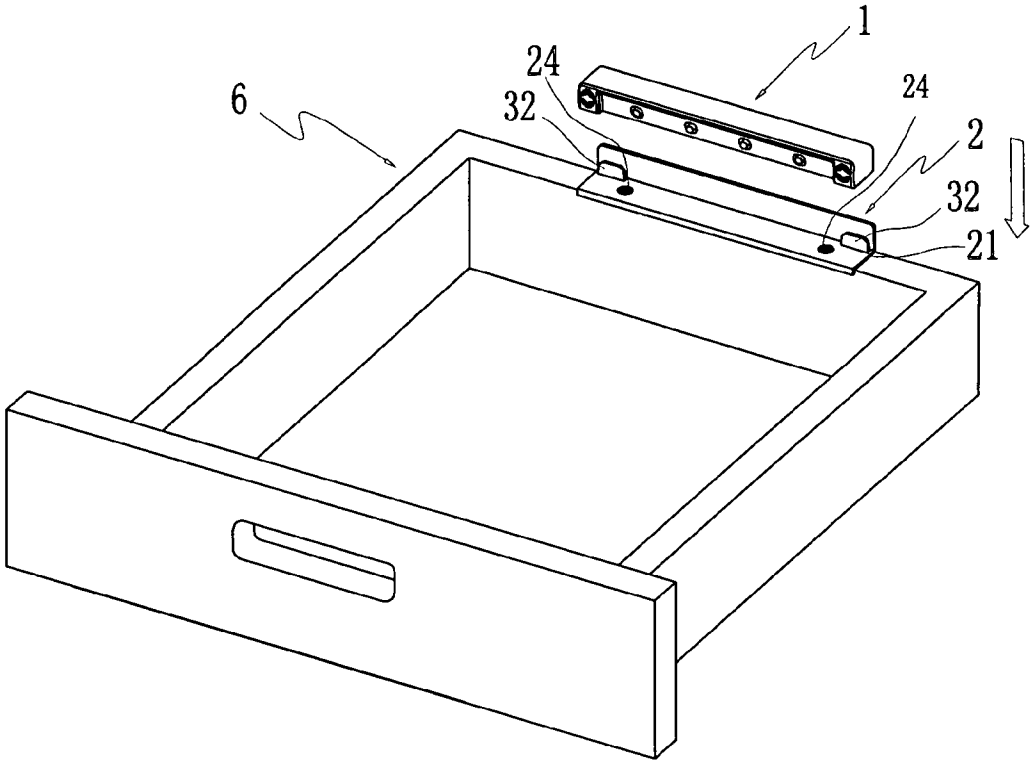
FIG. 6C is a perspective view showing a status after the base is installed according to the embodiment in which the lighting structure of the present invention is used.
Figure 6D:
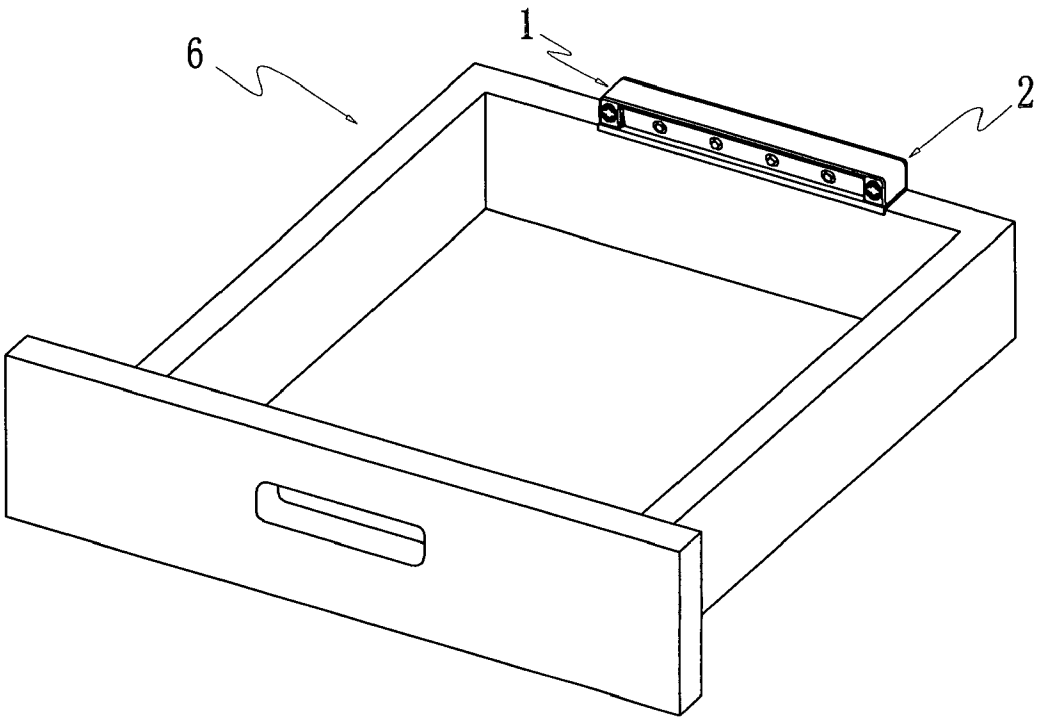
FIG. 6D is a perspective view showing a status when installation of the body is completed according to the embodiment in which the lighting structure of the present invention is used.

FIG. 6A is a perspective view showing a battery-installed status of the lighting structure of the present invention. FIG. 6B is a perspective view showing a status before the base is installed according to an embodiment in which the lighting structure of the present invention is used. FIG. 6C is a perspective view showing a status after the base is installed according to the embodiment in which the lighting structure of the present invention is used. FIG. 6D is a perspective view showing a status when installation of the body is completed according to the embodiment in which the lighting structure of the present invention is used. Referring to FIG. 6A through FIG. 6D, based on the aforesaid embodiment of the lighting structure having the battery holder of the present invention, assembly of the lighting structure of the present invention is accomplished in the following order. The batteries 45 are first installed into the battery holder of the second space 12 of the body 1 and other elements are then installed sequentially. Then, the base 2 is fixedly locked onto a drawer 6 of the cabinet by inserting the screw 24 through the corresponding through hole 23 in the base plate 21 of the base 2. Afterward, through engagement of the concave hole (as shown in FIG. 2) of the first engagement portion 31 at the bottom of the body 1 with the convex plate of the second engagement portion 32 on the base plate 21 of the base 2, the body 1 is fixedly disposed on the base 2, i.e., on the drawer 6.

Figure 6E:
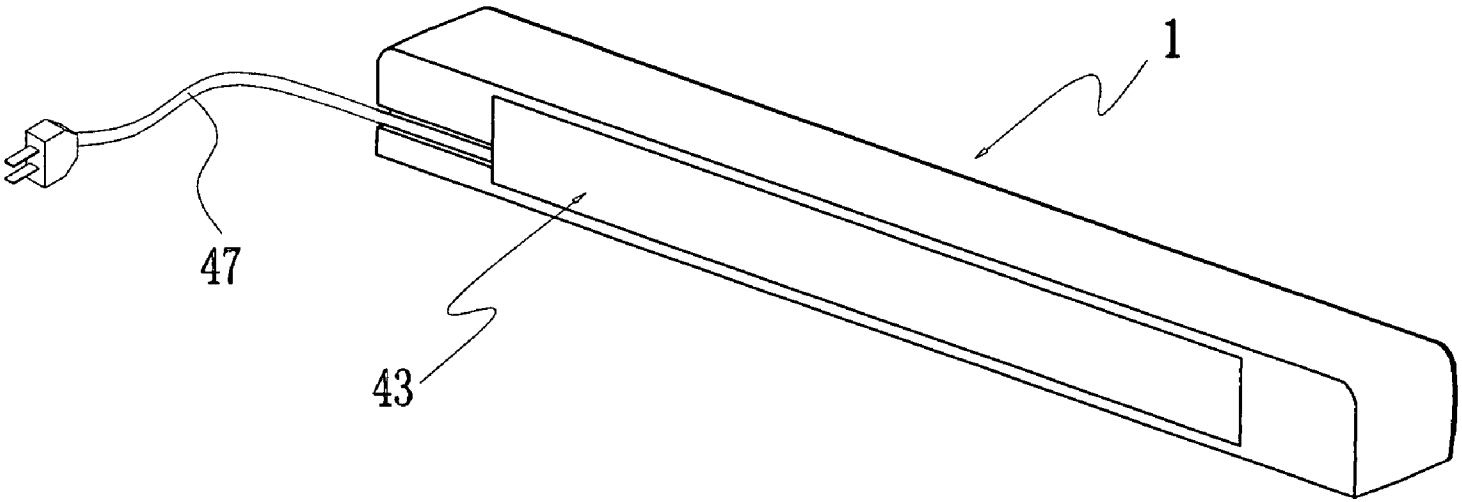
FIG. 6E is a perspective view of the lighting structure of the present invention using an external power source.

FIG. 6E is a perspective view of the lighting structure of the present invention using an external power source. Referring to FIG. 6A through FIG. 6D, the electric power supplying portion 43 in the body 1 is an electrical device for regulating an external power source, and has a power supply cord 47 for electrical connection to the external power source. In an embodiment, the electric power supplying portion 43 may comprise an alternating current to direct current (AC/DC) converting circuit, and the external power source is a utility power system. Therefore, during assembly of the lighting structure of the present invention, the body 1 can be electrically connected to the utility power system through the power supply cord 47 to supply electric power necessary for the aforesaid electrical circuit 4.

Figure 7:
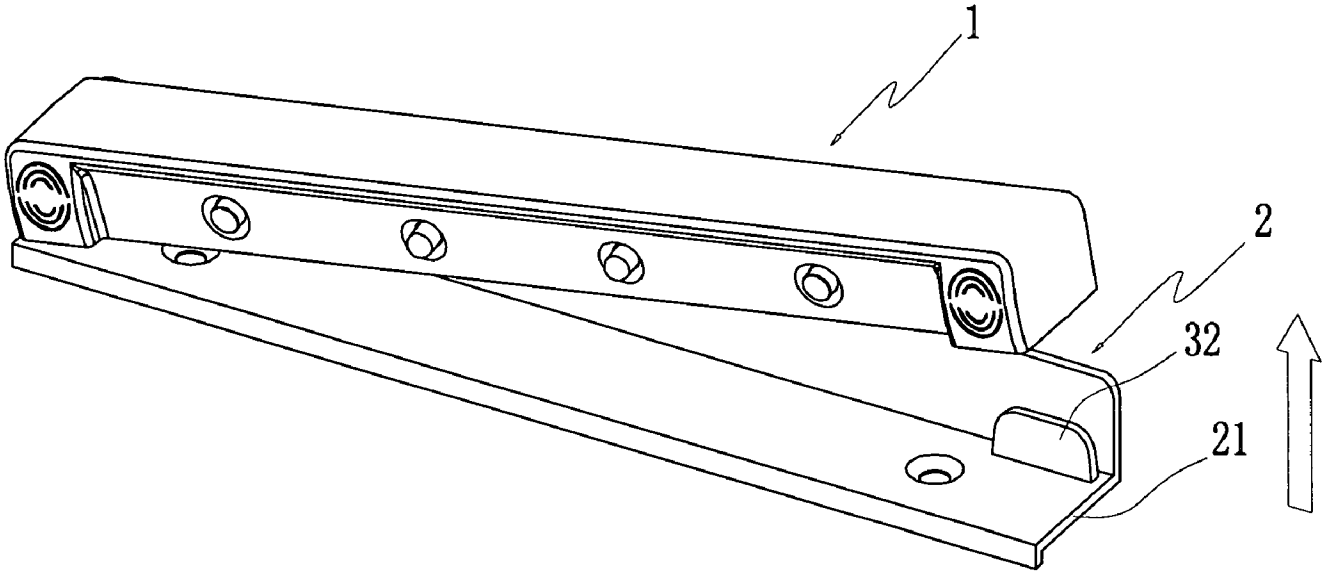
FIG. 7 is a perspective view showing a status when the body is disassembled according to the embodiment in which the lighting structure of the present invention is used.

FIG. 7 is a perspective view showing a status when the body is disassembled according to the embodiment in which the lighting structure of the present invention is used. Referring to FIG. 7, during disassembly of the lighting structure of the present invention, an end of the body 1 can be pivoted with the convex plate of the second engagement portion 32 disposed at the other end of the base plate 21 of the base 2 as a pivot point, as shown by the arrow in FIG. 7. Thus, the concave hole (as show in FIG. 2) of the first engagement portion 31 at the bottom of the body 1 disengages from the convex plate of the second engagement portion 32 on the base plate 21 of the base 2; i.e., the body 1 is separated from the base 2. Thereby, operations including battery replacement can be accomplished.

In the lighting structure of the present invention, the front surface of the body 1 has a texture 112 at both sides thereof respectively. The textures 112 are patterns protruding from the surface, and when an end of the body 1 pivots against the convex plate of the second engagement portion 32 at the other end of the base plate 21 of the base 2, an operator can press the textures 112 to obtain an increased friction force, thereby improving operating convenience in disassembling the body 1.

Additionally, between the two sides with the textures 112 of the front surface of the lighting structure of the present invention described above is partially formed a concave surface 113. The concave surface 113 dips downwards so that the concave surface 113 is lower than the parts of the front surface with the textures 112, which helps to further protect the lamp 5 exposed at the front surface of the body 1.

Figure 8:
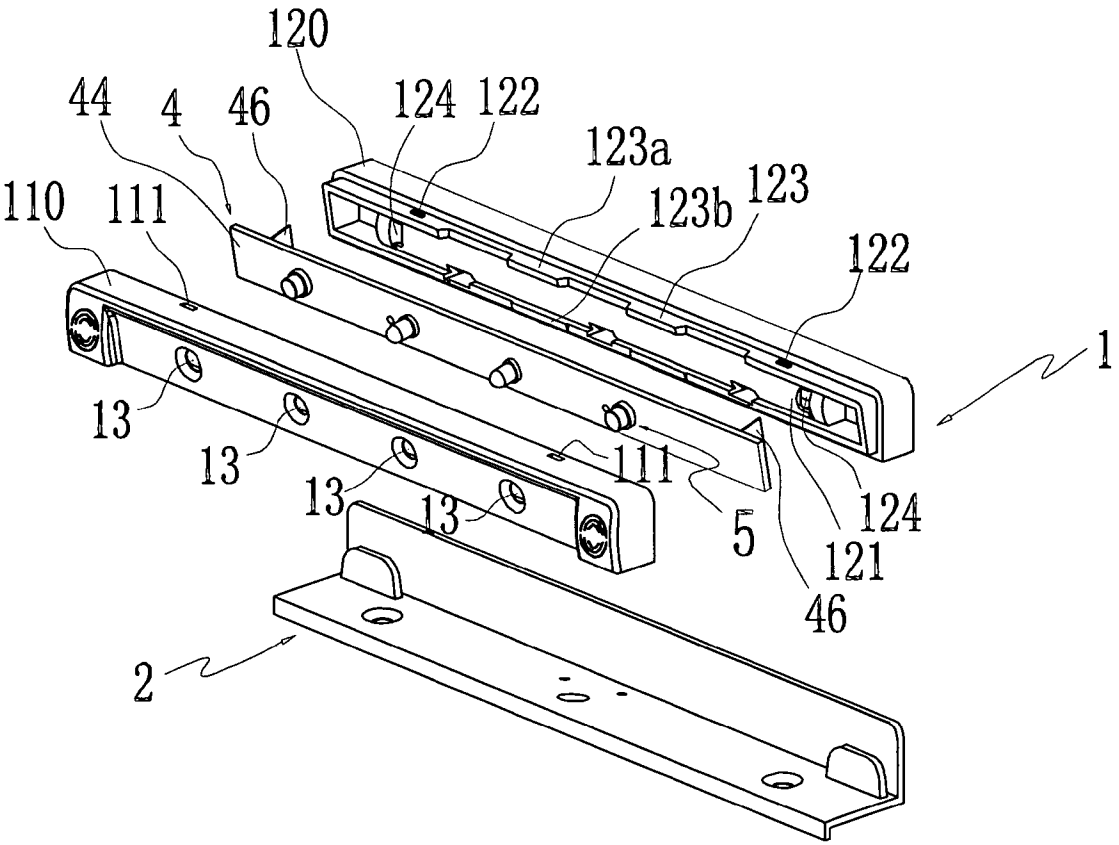
FIG. 8 is a perspective view showing an exploded status of an embodiment of the lighting structure of the present invention.
Figure 9:
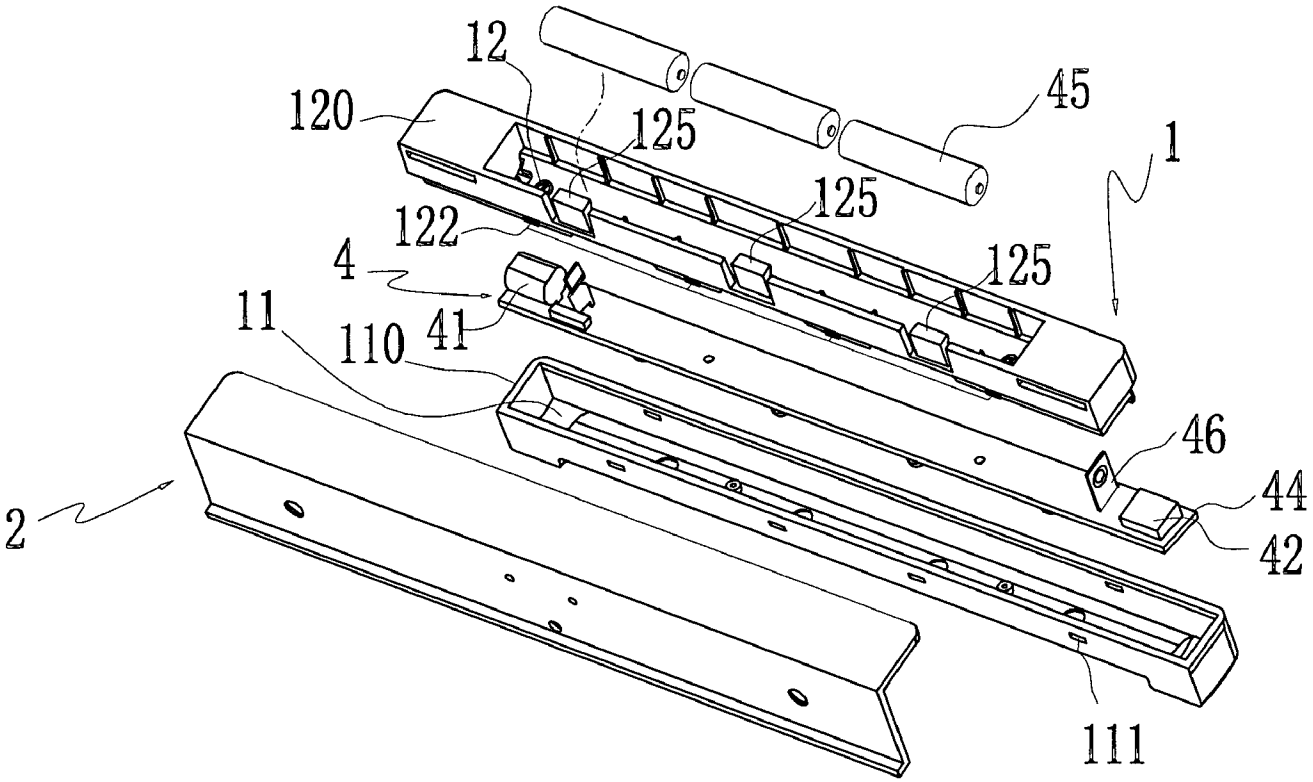
FIG. 9 is a perspective view of the embodiment of FIG. 8 of the present invention from another viewing angle.
Figure 10:
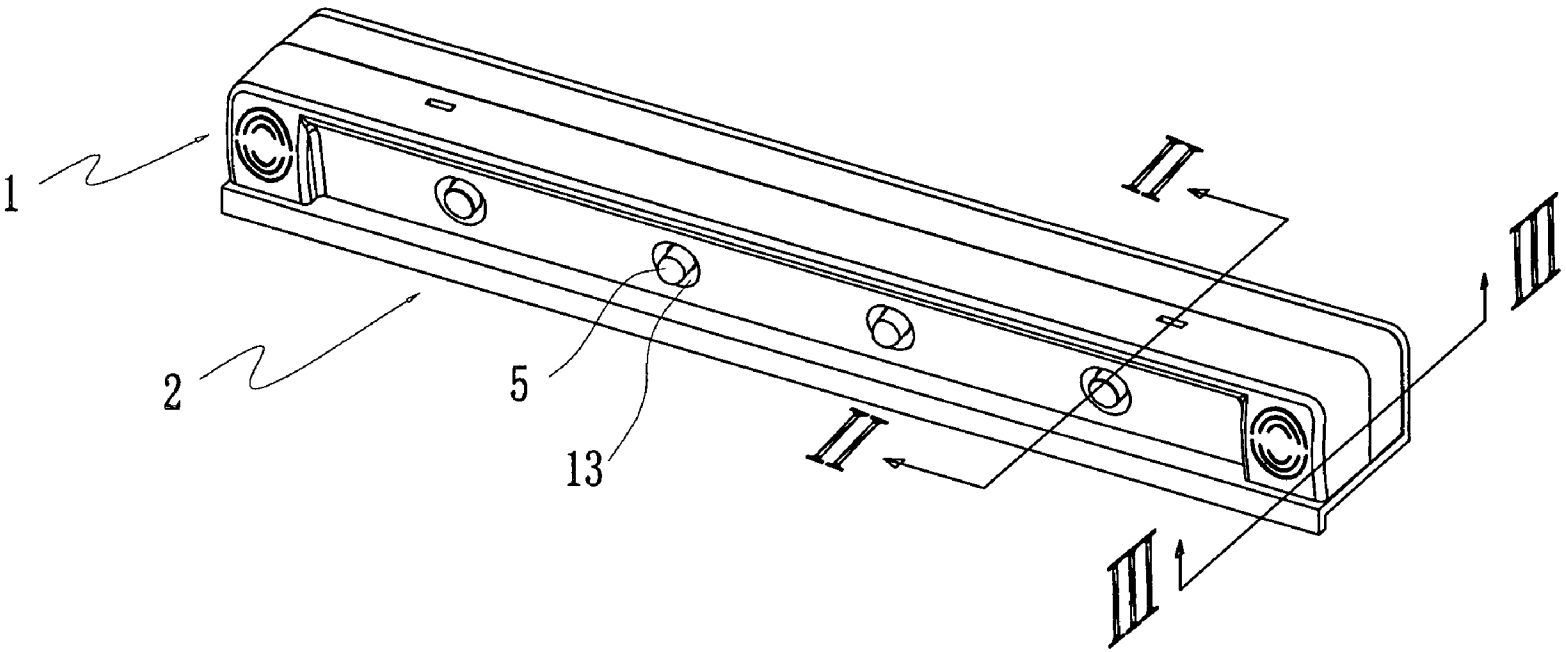
FIG. 10 is a perspective view showing an assembled status of the embodiment of FIG. 8 of the present invention.
Figure 11A:
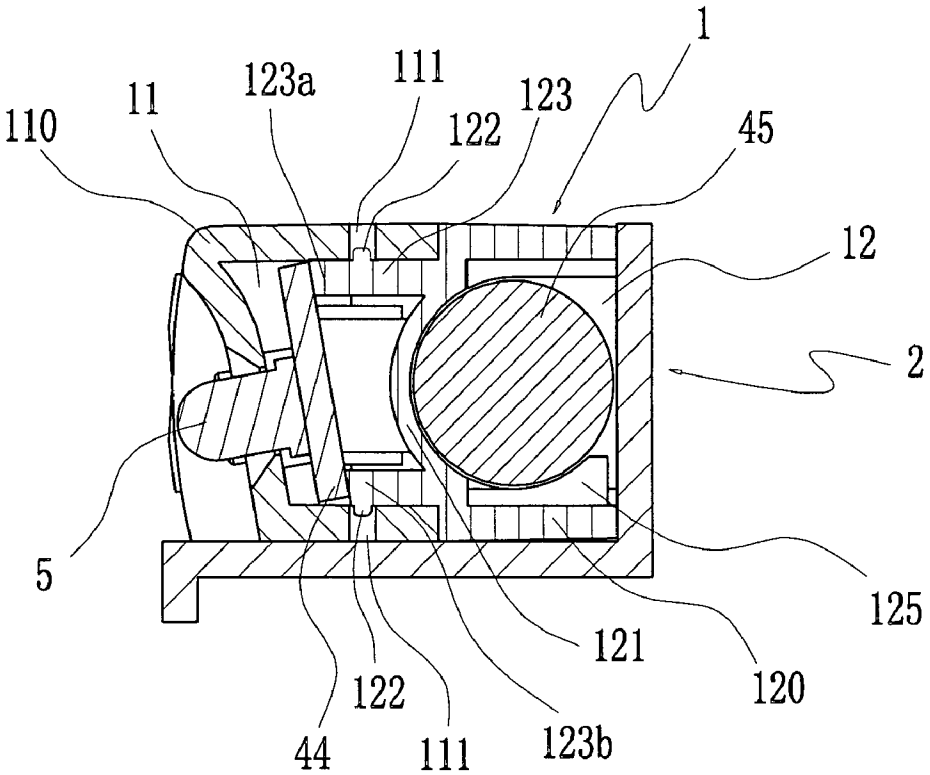
FIG. 11*a* is a cross-sectional view showing a cross-section along line II-II in the embodiment of FIG. 10 of the present invention.
Figure 11B:
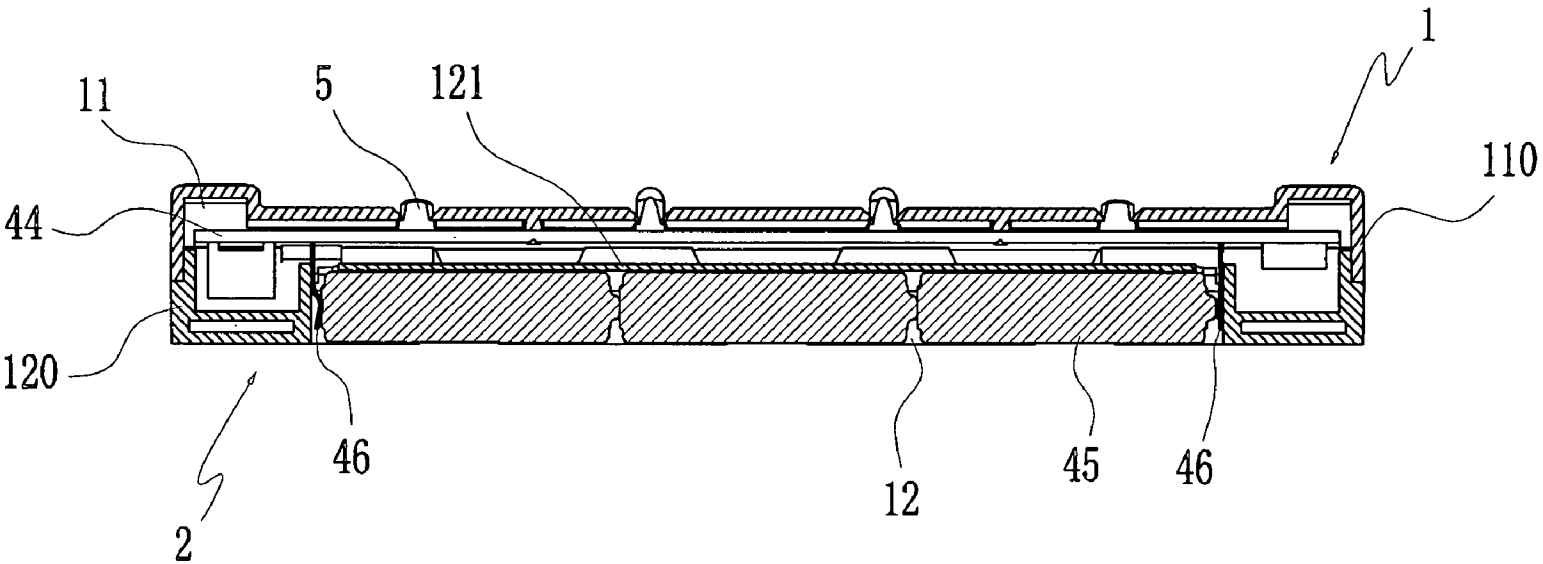
FIG. 11*b* is a cross-sectional view showing a cross-section along line III-III in the embodiment of FIG. 10 of the present invention.

FIG. 8 is a perspective view showing an exploded status of an embodiment of the lighting structure of the present invention. FIG. 9 is a perspective view of the embodiment of FIG. 8 of the present invention from another viewing angle. FIG. 10 is a perspective view showing an assembled status of the embodiment of FIG. 8 of the present invention. FIG. 11*a* is a cross-sectional view showing a cross-section along line II-II in the embodiment of FIG. 10 of the present invention. FIG. 11*b* is a cross-sectional view showing a cross-section along line III-III in the embodiment of FIG. 10 of the present invention. Referring to FIGS. 8, 9, 10, 11*a* and 11*b*, on basis of the lighting structure of the present invention described above, the body 1 further comprises a front cover 110 and a rear cover 120. The front cover 110 and the rear cover 120 are a hollow shell, respectively, and the front cover 110 has an opening extending through the hollow interior portion at a rear end thereof. The rear cover 120 has an opening extending through the hollow portion at a front end and a rear end thereof respectively, and has a partition 121 which divides the hollow interior portion thereof in such a way that the first space 11 is formed by a space surrounded by the rear end of the front cover 110 and the front end of the rear cover 120. Additionally, within the rear end of the rear cover 120 is formed the second space 12, the first space 11 is adapted to accommodate the electrical circuit 4, and the second space 12 forms the battery holder that can accommodate a plurality of batteries 45 and is electrically connected to the electrical circuit 4. Furthermore, a plurality of through mortises 111 is formed at a periphery of the opening of the rear end of the aforesaid front cover 110, and a plurality of tenons 122 corresponding to these mortises 111 is formed at a periphery of the opening of the front end of the rear cover 120. These mortises 111 are through holes extending through the wall and these tenons 122 are flanges protruding from the surface, so these tenons 122 can be held into the corresponding mortises 111 respectively to join the front cover 110 with the rear cover 120.

On basis of the electrical circuit 4 of the aforesaid lighting structure, the electrical circuit 4 may further comprise a circuit board 44. The circuit board 44 is disposed in the body 1, and the vibration sensing element 41 and the control element 42 are also disposed on the circuit board 44.

The aforesaid lamp 5 may be disposed on a front surface of the circuit board 44 so that when the circuit board 44 is disposed in the body 1, the lamp 5 is corresponded to the lamp hole 13 of the body 1.

The aforesaid lamp 5 may be a light emitting diode (LED) lamp.

According to a specific practice for the aforesaid embodiment of the present invention, at a periphery of the front-end opening of the aforesaid rear cover 120 is disposed a support portion 123 which has an outside diameter smaller than an inside diameter of the rear-end opening of the front cover 110, and the tenons 122 are flanges protruding from the surface around the support portion 123. Thereby, the support portion 123 can be engaged into the rear-end opening of the front cover 110 and the each tenon 122 can be held into the corresponding mortise 111 in the front cover 110 so as to join the front cover 110 to the rear cover 120. Additionally, the circuit board 44 accommodated in the first space 11 is disposed on the end surface of the support portion 123 in such a way that each of the lamps 5 on the circuit board 44 can be disposed and correspond to each of the lamp holes 13 of the body 1, respectively.

In the aforesaid rear cover 120, the support portion 123 at least comprises a first end surface 123*a* and a second end surface 123*b*. The first end surface 123*a* extends in a direction of the front opening of the rear cover 120 to a distance longer than a distance to which the second end surface 123*b* extends in the direction of the front opening of the rear cover 120 so that the front surface with lamps 5 of the circuit board 44 is formed to be inclined.

The aforesaid circuit board 44 has two conductive portions 46 therein, which serve as a positive-electrode conductor and a negative-electrode conductor for electric power input of the circuit board 44 respectively. Furthermore, the partition 121 of the aforesaid rear cover 120 has two apertures 124 therein corresponding to the conductive portions 46 in the circuit board 44, respectively, and the conductive portions 46 in the circuit board 44 extend from the circuit board 44 through the corresponding apertures 124 into the second space 12 of the rear cover 120. Thereby, the second space 12 forms the battery holder that can accommodate a plurality of batteries 45 and is electrically connected to the circuit board 44.

The conductive portions 46 in the circuit board 44 described above are an electrical conductor made up of a copper sheet respectively.

Referring to FIGS. 9, 11*a* and 11*b* again, the batter holder formed by the second space 12 of the rear cover 120 described above is a structure in which batteries are arranged in series connection, and has a plurality of barbs 125 disposed on a side thereof for fastening the batteries 45 in the battery holder. Furthermore, each of the aforesaid barbs 125 is an elastic plate formed by extending upwards from a side edge of the bottom of the battery holder respectively. The barbs 125 can provide a lateral elastic force respectively, and each of the barbs 125 has a top end which is an arc-shaped flange extending parallel to the opening portion of the battery holder respectively and is adapted to fasten the batteries 45 in the battery holder.

Figure 12:
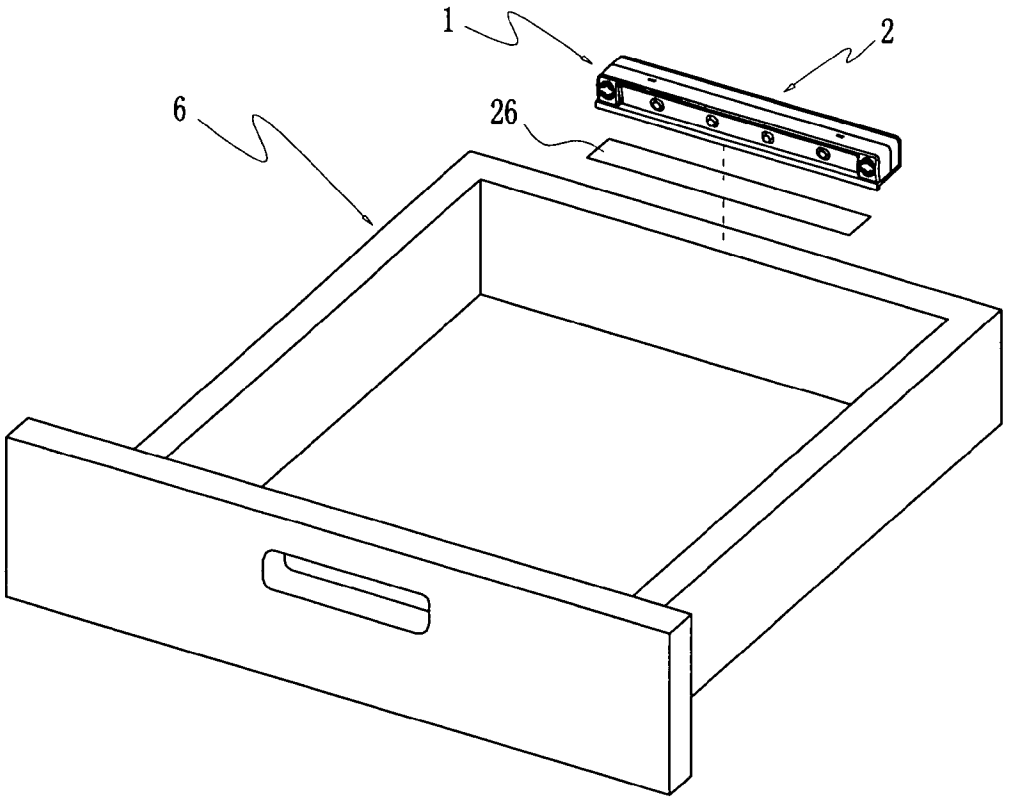
FIG. 12 is a perspective view showing an exploded status of an embodiment of the lighting structure of the present invention.
Figure 13:
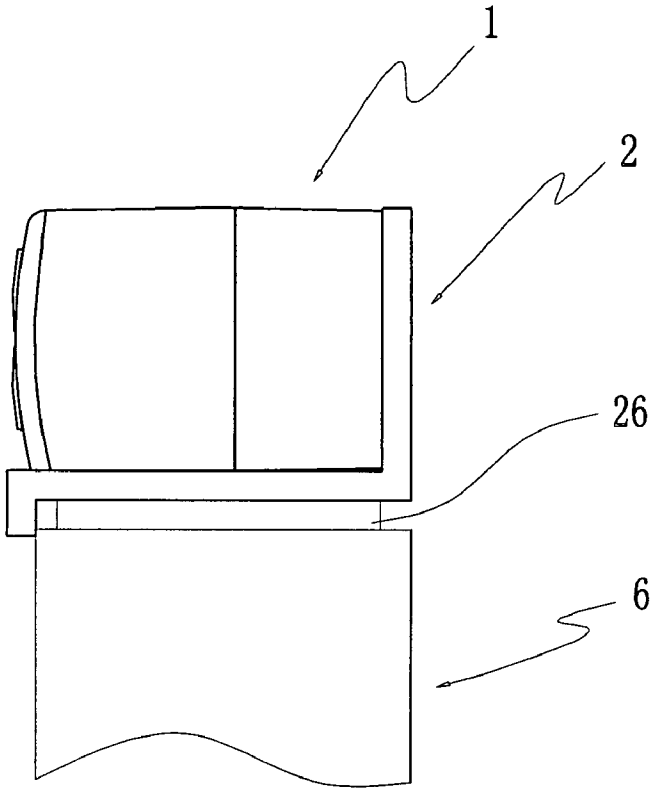
FIG. 13 is a side view showing an assembled status of the embodiment of FIG. 12 of the present invention.

FIG. 12 is a perspective view showing an exploded status of an embodiment of the lighting structure of the present invention, and FIG. 13 is a side view showing an assembled status of the embodiment of FIG. 12 of the present invention. Referring to FIG. 12 and FIG. 13, in the embodiment of the lighting structure of the present invention, the base 2 may also be fixedly disposed on the drawer 6 by using a double sided tape 26 to adhere a lower surface of the base plate 21 to the drawer 6 of the cabinet, and the body 1 disposed on the base 2 is installed on the drawer 6. In this way, the lighting structure of the present invention can be disposed in the drawer 6 of the cabinet by using the double sided tape 26.

Figure 14:
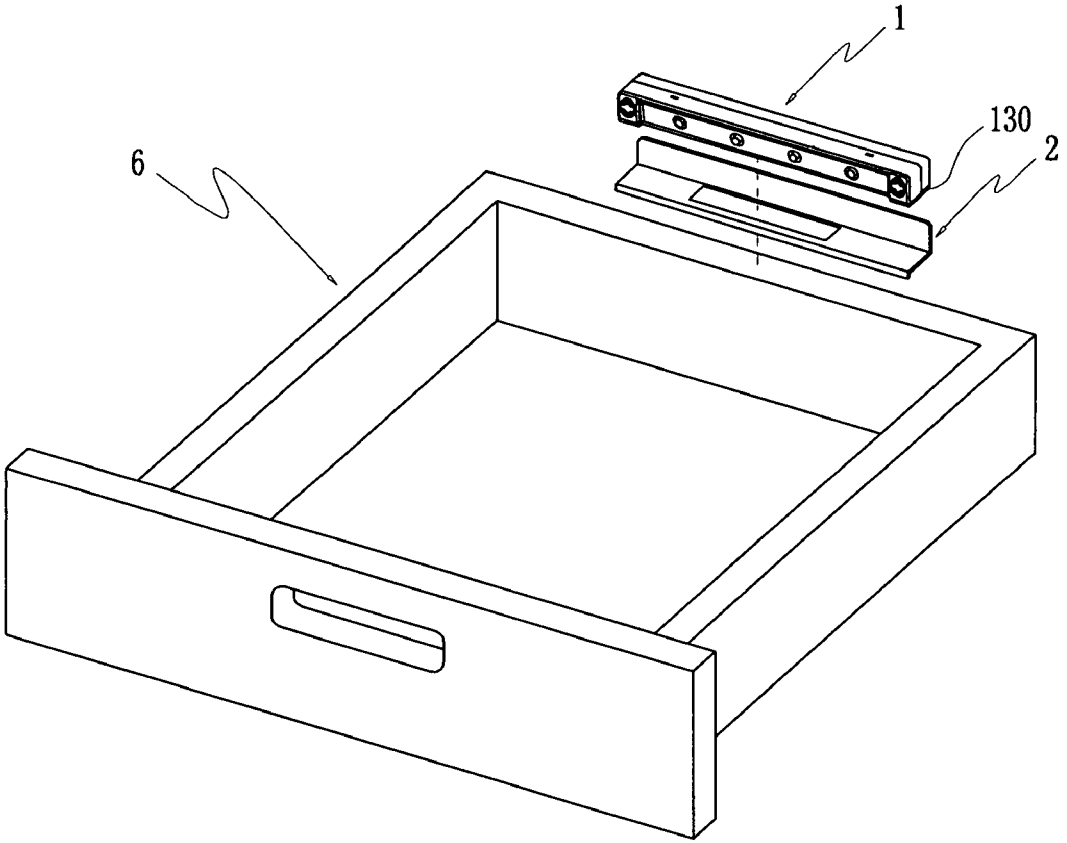
FIG. 14 is a perspective view showing an exploded status of an embodiment of the lighting structure of the present invention.
Figure 15:
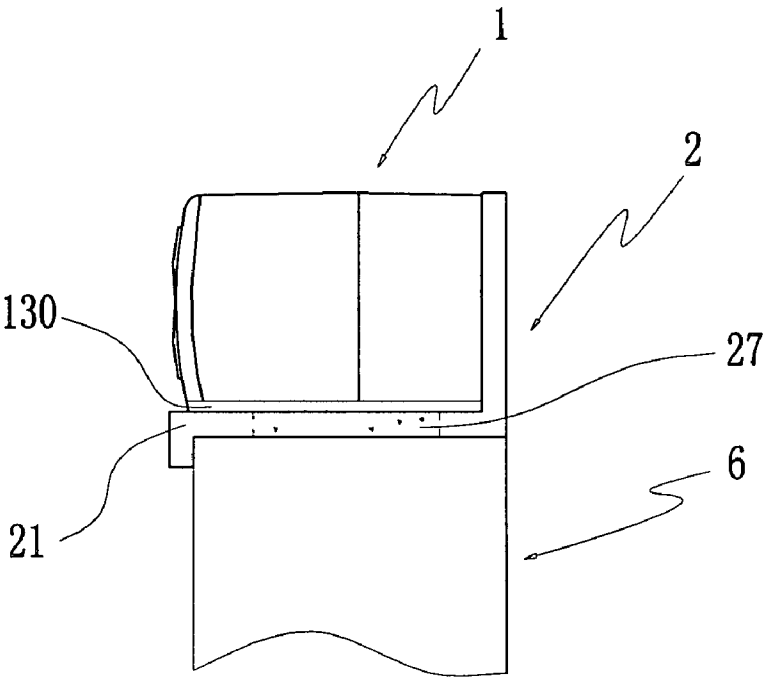
FIG. 15 is a side view showing an assembled status of the embodiment of FIG. 14 of the present invention.

FIG. 14 is a perspective view showing an exploded status of an embodiment of the lighting structure of the present invention, and FIG. 15 is a side view showing an assembled status of the embodiment of FIG. 14 of the present invention. Referring to FIG. 14 and FIG. 15, in a further embodiment of the lighting structure of the present invention, the first engagement portion 31 in the body 1 comprises at least one iron plate 130, which is a sheet that is disposed on a bottom surface of the body 1 and can be attracted by a magnet; and the second engagement portion 32 in the base 2 is a magnet 27 corresponding to the iron plate 130. The magnet 27 is disposed in the base plate 21 of the base 2 so that the iron plate 130 and the magnet 27 can attract or separate from each other for purpose of joining the body 1 and the base 2 with each other or separating them from each other. Additionally, when the lighting structure of the present invention is used in a cabinet made of an iron material, the base 2 can be fixedly disposed in the cabinet 6' by the magnet 27 in the base plate 21 of the base 2.

Figure 16:
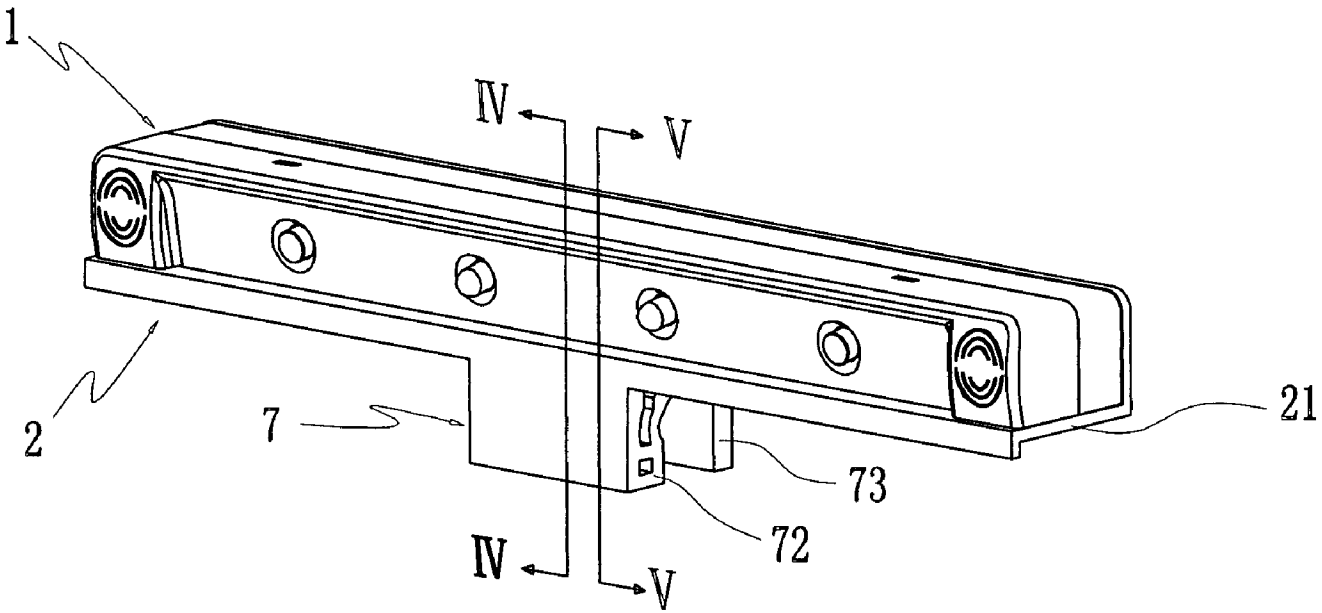
FIG. 16 is a perspective view showing an assembled status of another embodiment of the lighting structure of the present invention.
Figure 17:
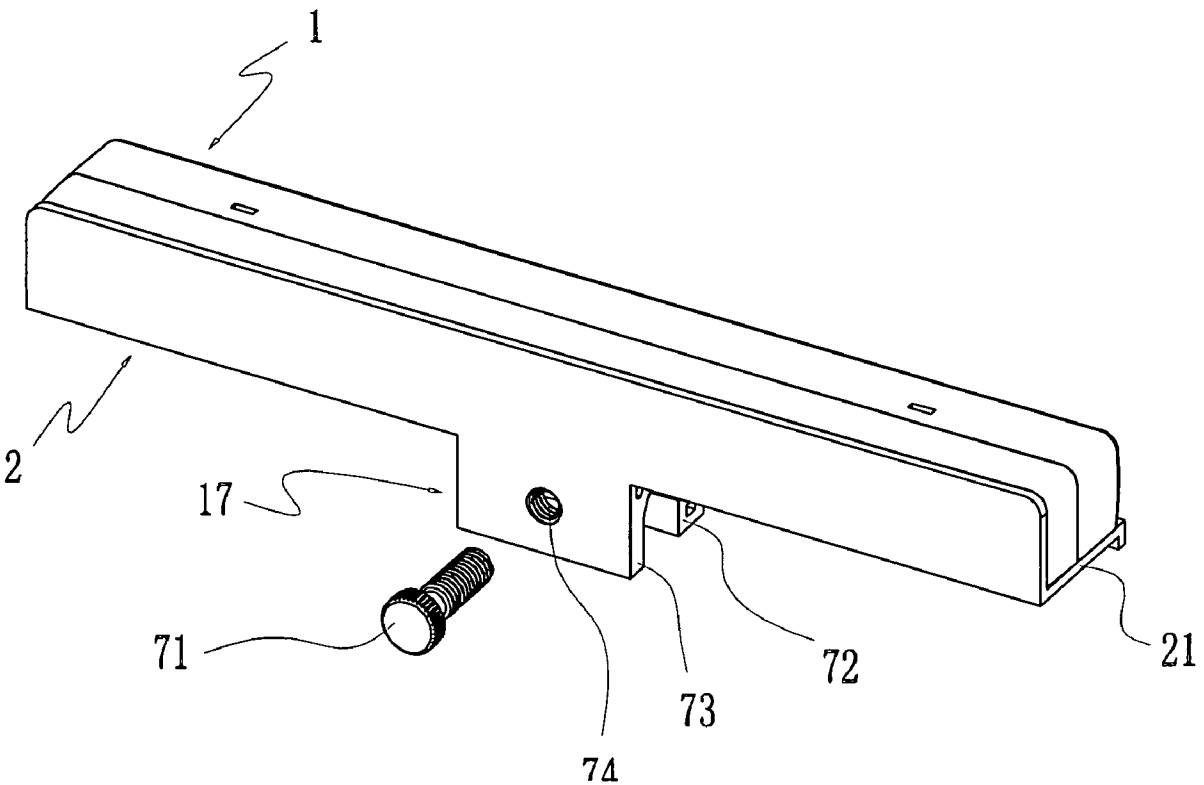
FIG. 17 is a perspective view showing an exploded view of the embodiment of FIG. 16 of the present invention.

FIG. 16 is a perspective view showing an assembled status of another embodiment of the lighting structure of the present invention, and FIG. 17 is a perspective view showing an exploded status of the embodiment of FIG. 16 of the present invention. Referring to FIG. 16 and FIG. 17, in a further embodiment of the lighting structure of the present invention, the lighting structure further has a fixing mount 7 and a bolt 71, and the fixing mount 7 is formed on the bottom of the base plate 21 of the base 2. The fixing mount 7 comprises a front gripping portion 72 and a rear gripping portion 73. The front gripping portion 72 and the rear gripping portion 73 are two plate structures facing each other, and the rear gripping portion 73 has a screw hole 74 extending through the rear gripping portion 73 along an anterior-posterior direction of the rear gripping portion 73. Thereby, the bolt 71 can be threaded into the screw hole 74 of the rear gripping portion 73, and by virtue of restriction imposed by an inner surface of the front gripping portion 72 and a front end edge of the bolt 71, the fixing mount 7 can be fixedly disposed on a plate or an iron wire structure of a basket structure (not shown).

Figure 18:
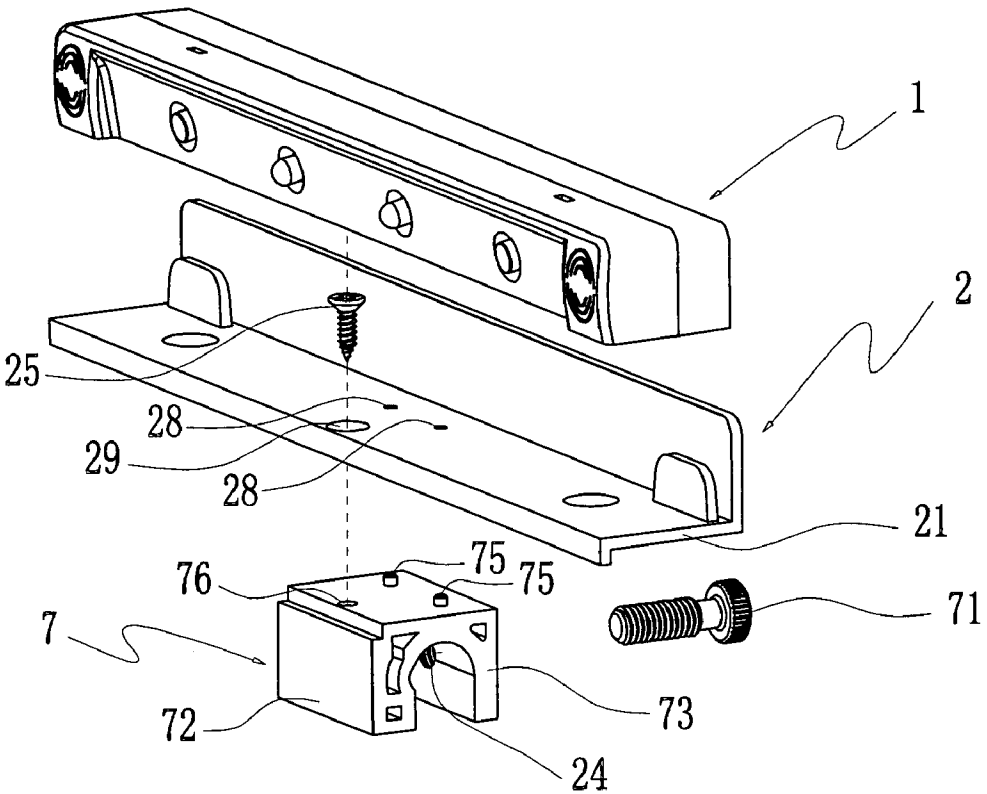
FIG. 18 is a perspective view showing an exploded status of the another embodiment of FIG. 16 of the present invention.
Figure 19A:
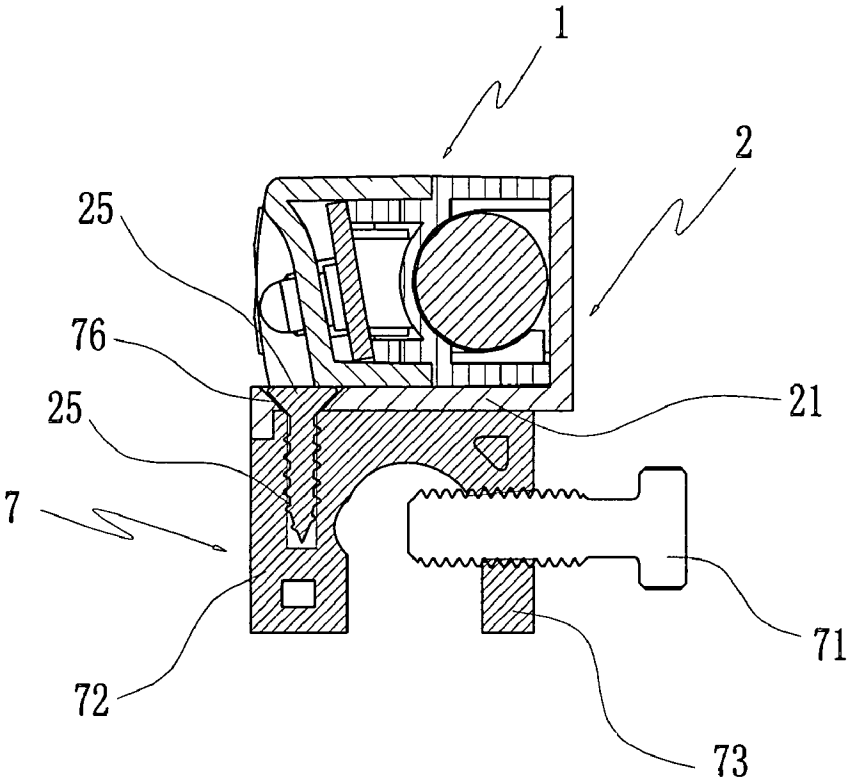
FIG. 19A is a cross-sectional view showing an assembled status of the embodiment of FIG. 18 of the present invention.
Figure 19B:
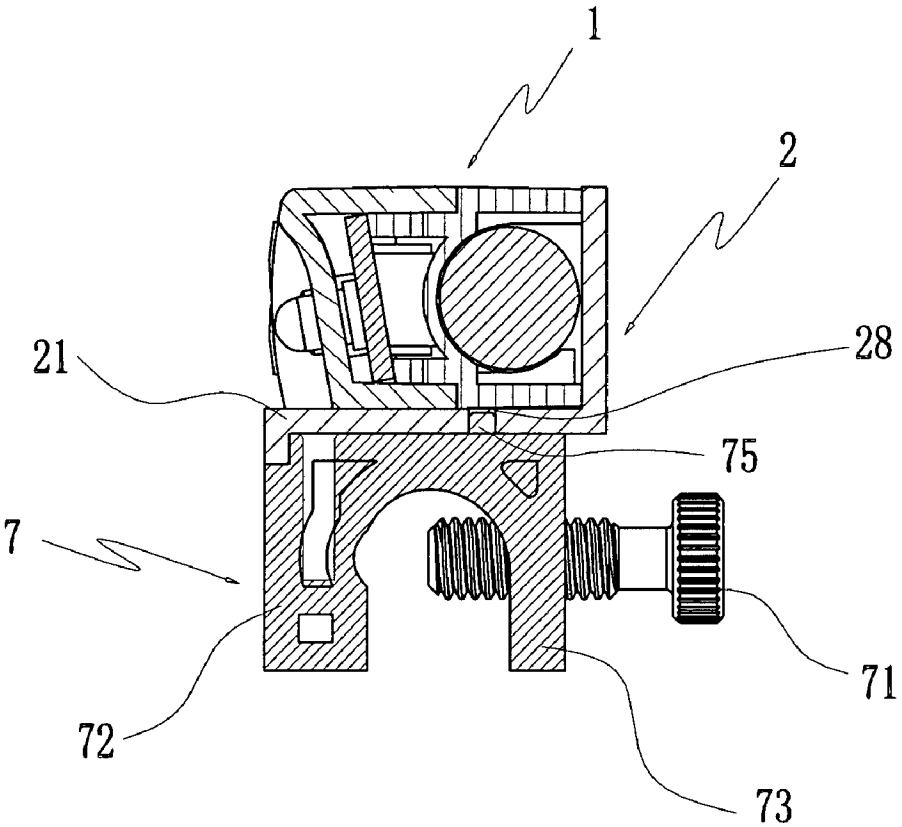
FIG. 19B is another cross-sectional view showing the assembled status of the embodiment of FIG. 18 of the present invention.

FIG. 18 is a perspective view showing an exploded status of the another embodiment of FIG. 16 of the present invention. FIG. 19A is a cross-sectional view showing an assembled status of the embodiment of FIG. 18 of the present invention. FIG. 19B is another cross-sectional view showing the assembled status of the embodiment of FIG. 18 of the present invention. Referring to FIGS. 16, 18, 19A and 19B, the lighting structure of the present invention further comprises a screw 25 and the fixing mount 7 further has at least one screw hole 76 in a top end thereof, while the base plate 21 of the base 2 has a corresponding through hole 29 so that the screw 25 can be inserted through the through hole 29 of the base plate 21 into the screw hole 76 of the fixing mount 7 to further lock the fixing mount 7 to the base plate 21. Additionally, the fixing mount 7 may further have a plurality of convex portions 75 on the top end thereof, and the base plate 21 of the base 2 has a plurality of corresponding concave portions 28 on the lower surface thereof. The aforesaid convex portions 75 are structures protruding from a top end surface of the fixing mount 7, and the concave portions 28 are concave structures in a bottom end surface of the base plate 21. Each of the concave portions 28 corresponds to a convex portion 75 respectively and can engage with the corresponding convex portion 75 so that the top end of the fixing mount 7 can further be fixedly joined to the base plate 21 through engagement of the convex portions 75 and the concave portions 28 of the base plate 21.

Figure 20:
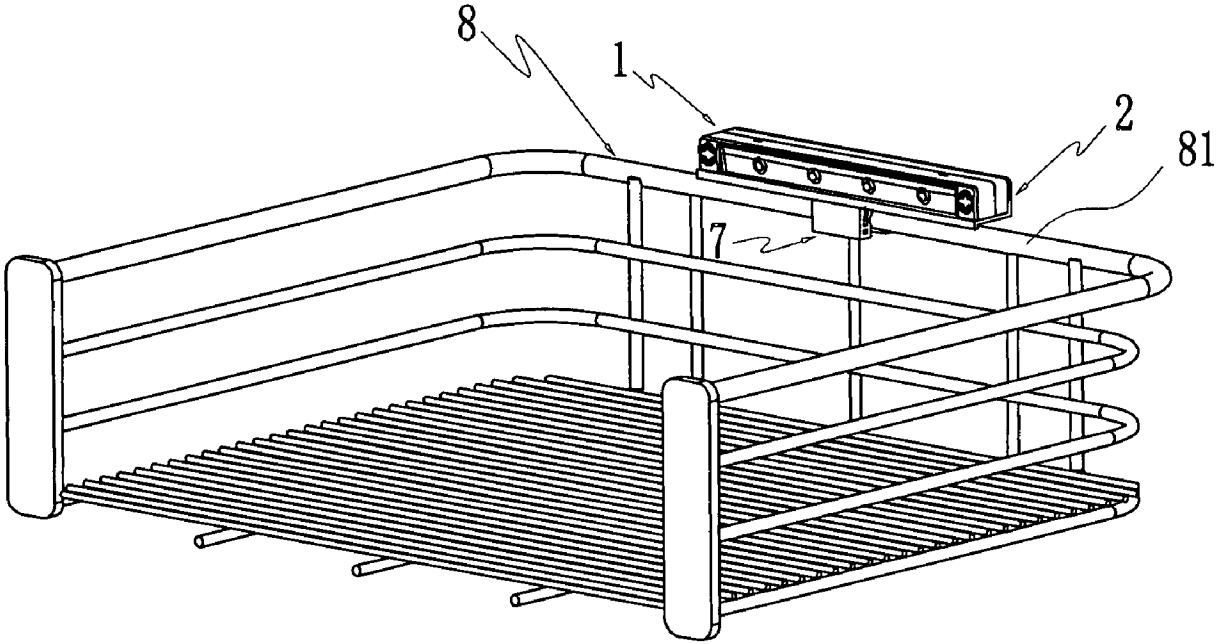
FIG. 20 is a perspective view showing a use status of the embodiment of FIG. 16 of the present invention.
Figure 21:
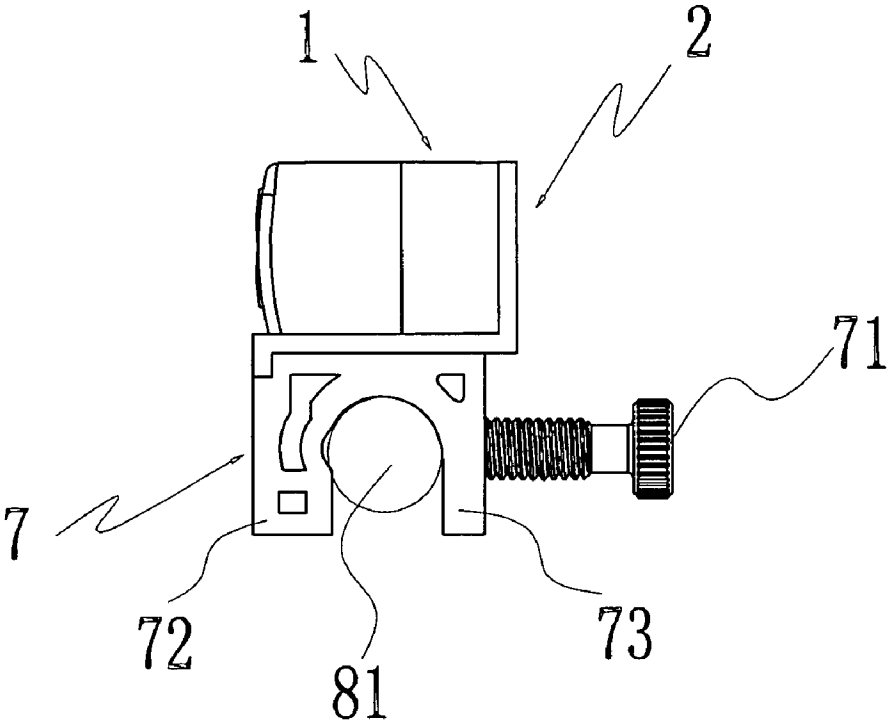
FIG. 21 is a side view of FIG. 19 of the present invention.

FIG. 20 is a perspective view showing a use status of the embodiment of FIG. 16 of the present invention, and FIG. 21 is a side view corresponding to FIG. 19 of the present invention. Referring to FIG. 20 and FIG. 21, in the aforesaid embodiment of the present invention where the fixing mount is further comprised, the lighting structure can be fixedly disposed on the plate or the iron wire structure of the basket structure through the fixing mount 7. Taking a case where the lighting structure is used in the basket structure as an example, an iron wire 81 of the basket structure 8 may be engaged between the front gripping portion 72 and the rear gripping portion 73 of the fixing mount 7; then, by screwing the bolt 71 into the screw hole 74 (as shown in FIG. 17) of the rear gripping portion 73 and through restriction imposed by the inner surface of the front gripping portion 72 and the front end edge of the bolt 71, the base 2 can be fixedly disposed on the iron wire 81 of the basket structure 8. Thus, the body 1 can be disposed on the iron wire 81 of the basket structure 8 through the fixing mount 7. In other words, when the lighting structure of the present invention is used in the basket structure 8, the lighting structure can be fixedly disposed in the basket structure 8 through the fixing mount 7 at the bottom of the base plate 21 of the base 2.

Figure 22:
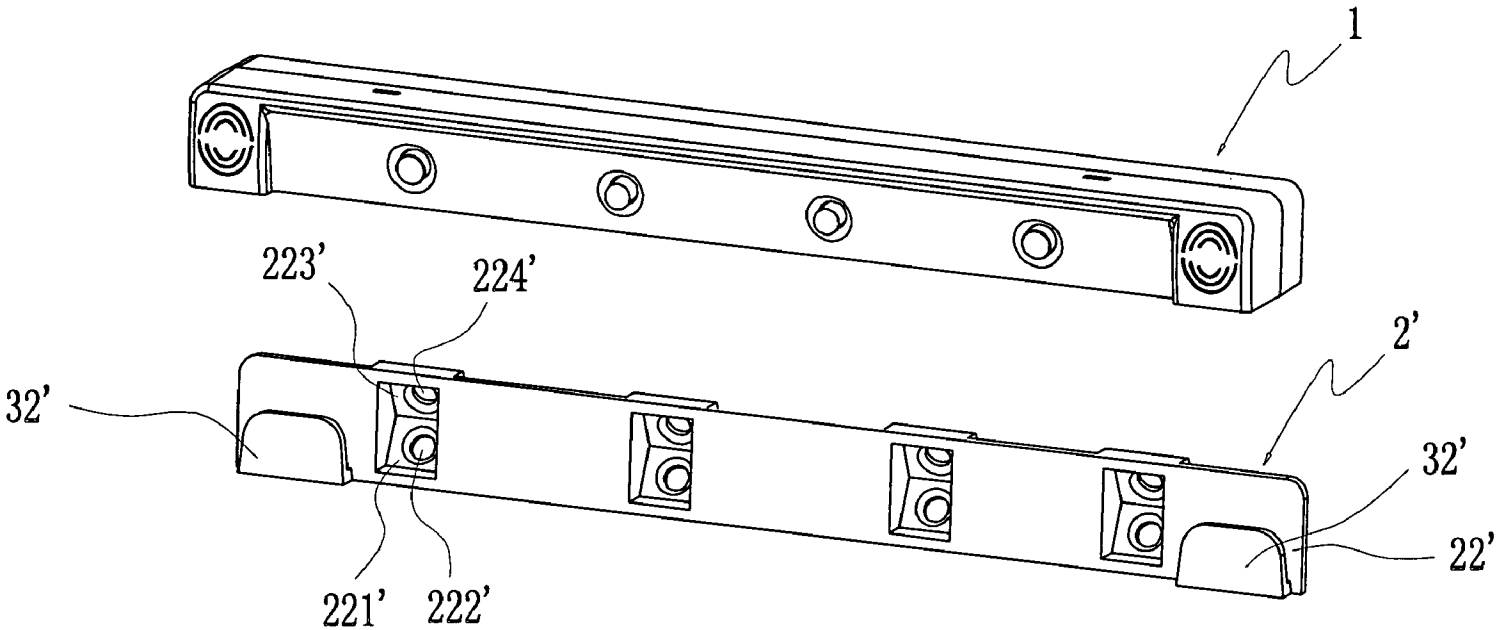
FIG. 22 is a perspective view showing an exploded status of a further embodiment of the lighting structure of the present invention.
Figure 23:
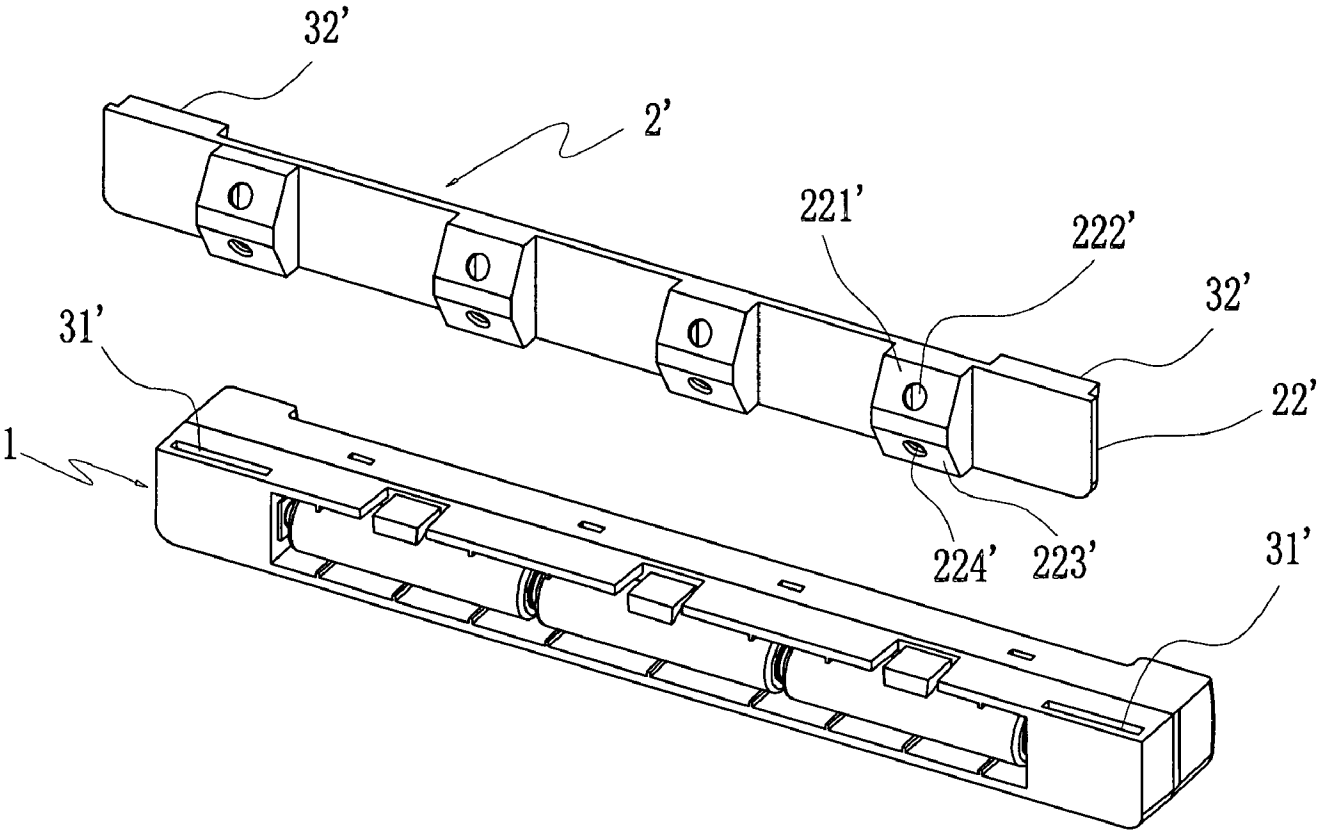
FIG. 23 is a perspective view showing an exploded status from another viewing angle of the embodiment of FIG. 22 of the present invention after being assembled.
Figure 24:
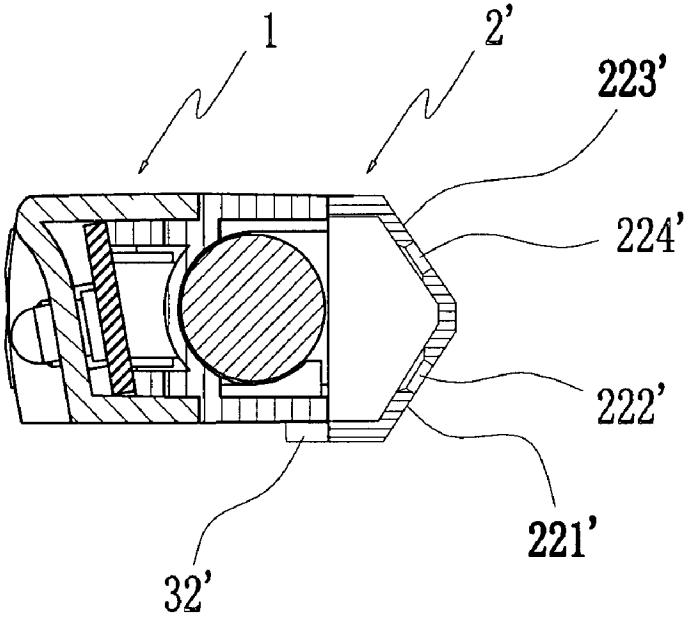
FIG. 24 is a side cross-sectional view of the embodiment of FIG. 22 of the present invention after being assembled.

FIG. 22 is a perspective view showing an exploded status of a further embodiment of the lighting structure of the present invention. FIG. 23 is a perspective view showing an exploded status from another viewing angle of the embodiment of FIG. 22 of the present invention after being assembled. FIG. 24 is a side cross-sectional view showing an assembled status of the embodiment of FIG. 22 of the present invention. Referring to FIGS. 22, 23 and 24, on basis of the aforesaid lighting structure of the present invention, this lighting structure further has a base 2', which comprises a back plate 22', a second engagement portion 32' and a first bevel portion 221'. The second engagement portion 32' is an L-shaped structure formed by extending the bottom of the back plate 22' of the base 2' forwards to an appropriate distance and then upwards. The first engagement portion 31 in the body 1 and the second engagement portion 32' in the base 2' form structures that can engage and, consequently, join with each other so that the body 1 and the base 2' can join with each other through engagement of the first engagement portion 31 with the second engagement portion 32'. The first bevel portion 221' is formed on the rear surface of the back plate 22', the first bevel portion 221' and the rear surface of the back plate 22' form an inclination angle, and the first bevel portion 221' has a first through hole 222' therein. The first through hole 222' is adapted for a screw (not shown) to be inserted therethrough to fix the first bevel portion 221' onto a structural part (not shown), any object which users want to install the lighting structure of the present invention, so that the base 2' and the surface of the structure form an inclination angle.

Additionally, referring to FIGS. 22, 23 and 24, on basis of the aforesaid lighting structure of the present invention, the base 2' may further has a second bevel portion 223' therein. The second bevel portion 223' is formed on the rear surface of the back plate 22'. The second bevel portion 223' and the rear surface of the back plate 22' form another inclination angle, and the second bevel portion 223' has a second through hole 224' therein. The second through hole 224' is adapted for a screw (not shown) to be inserted therethrough to fix the second bevel portion 223' onto a structural object (not shown) so that the base 2' and the surface of the structural object form an inclination angle. The first bevel portion 221' and the second bevel portion 223' have different surface directions.

An end of the first bevel portion 221' engages with an end of the second bevel portion 223', and a junction of the first bevel portion 221' and the second bevel portion 223' is of a convex structure.

Figure 25A:
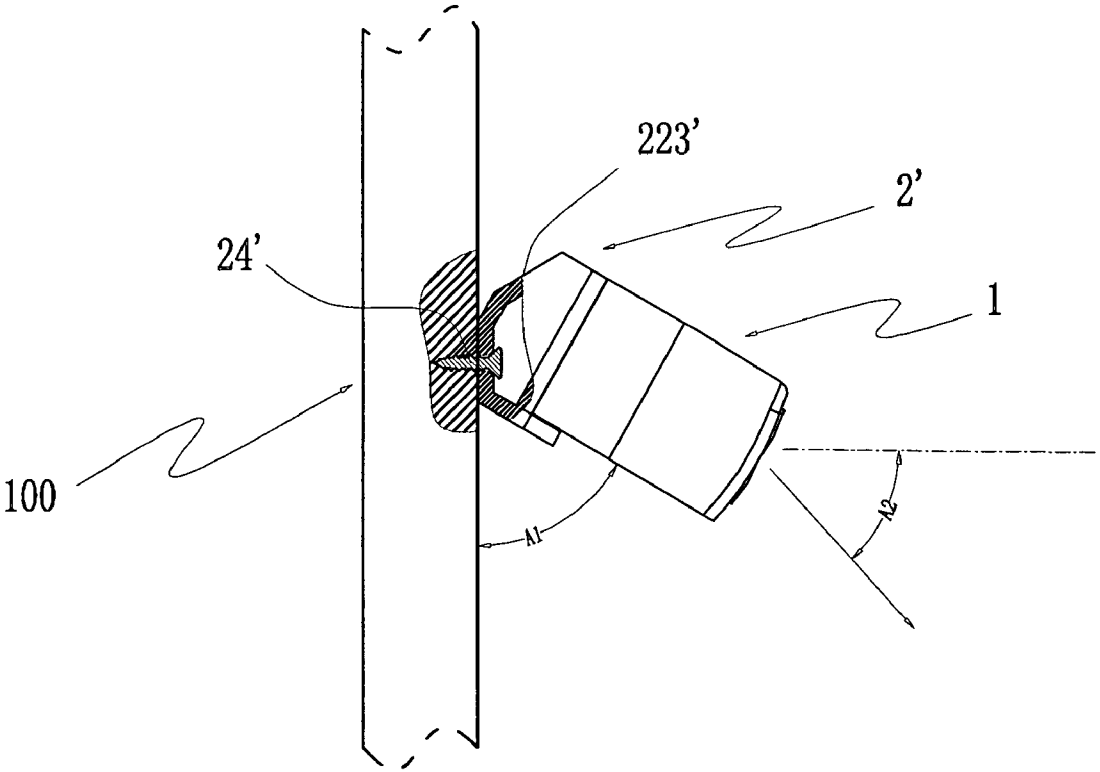
FIG. 25A is a side cross-sectional view showing a first use status of the embodiment of FIG. 22 of the present invention after being assembled.
Figure 25B:
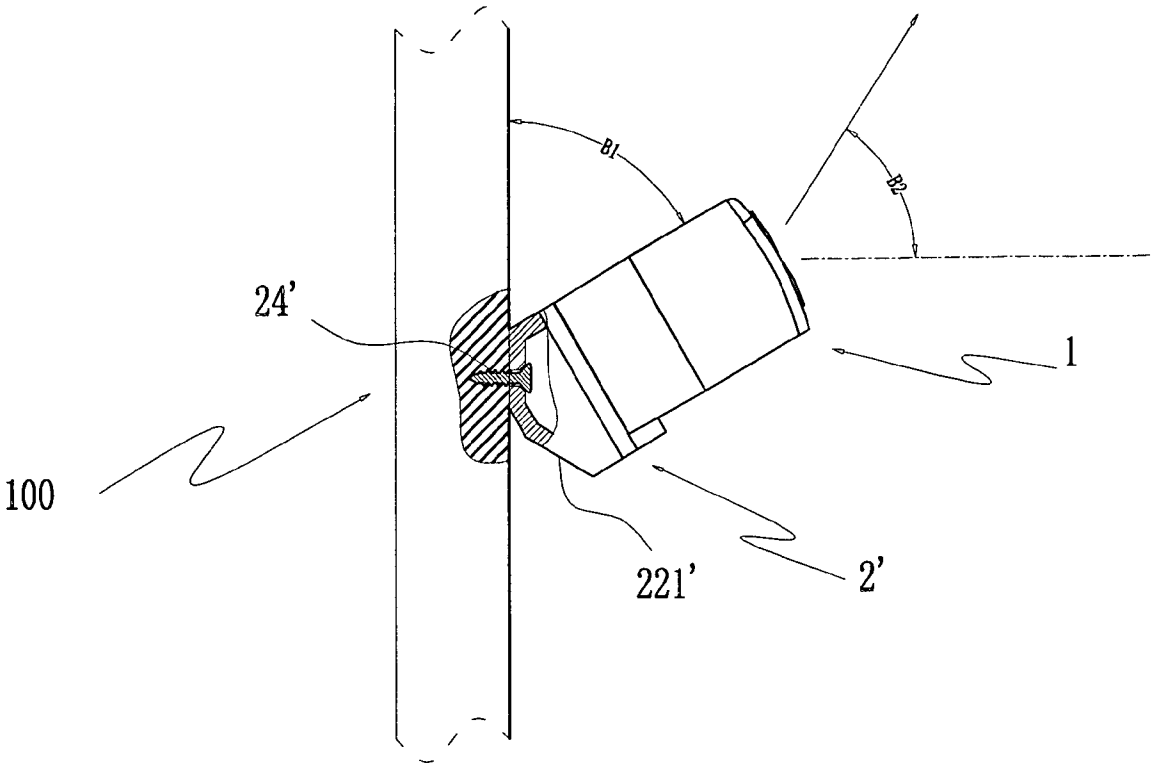
FIG. 25B is a side cross-sectional view showing a second use status of the embodiment of FIG. 22 of the present invention after being assembled.

FIG. 25A is a side cross-sectional view showing a first use status of the embodiment of FIG. 22 of the present invention after being assembled, and FIG. 25B is a side cross-sectional view showing a second use status of the embodiment of FIG. 22 of the present invention after being assembled. Referring to FIGS. 24, 25A and 25B together, during installation of the aforesaid base 2', when the base 2' is flatten onto a surface of a structural object 100 at the first bevel portion 221' of the back plate 22' and is locked onto the surface of the structural object 100 by inserting the screw 24' through the first through hole 222', a first inclination angle A1 is formed between the back plate 22' of the base 2' and the surface of the structural object 100 so that the lamps 5 of the body 1 disposed on the base 2' exhibit a first illumination angle A2 with respect to the horizontal direction; and when the base 2' is flatten onto the surface of the structural object 100 at the second bevel portion 223' of the back plate 22' and is locked onto the surface of the structural object 100 by inserting the screw 24' through the second through hole 224', a second inclination angle B1 is formed between the back plate 22' of the base 2' and the surface of the structural object 100 so that the lamps 5 of the body 1 disposed on the base 2' exhibit a second illumination angle B2 with respect to the horizontal direction. Therefore, when the base 2' is fixedly joined to the surface of the structural object 100, the illumination angle of the lamps 5 of the body 1 can be adjusted by choosing one of the first bevel portion 221' and the second bevel portion 223'.

In the aforesaid embodiment, the first bevel portion 221' and the second bevel portion 223' may also be fixedly disposed on the surface of the structural object 100 by a double sided tape or a magnet (not shown) so that the base 2' of the lighting structure of the present invention can be disposed conveniently.

Referring to FIGS. 22 and 23 again, on basis of the aforesaid lighting structure of the present invention, a central distance of two of the first through holes 222' is compatible with "32 mm-furniture-system" which is a normal central distance of holes for screws or pins of cabinet products. Therefore, the central distance of two of the first through holes 222' can be a multiple of 16 mm or a multiple of 32 mm. For a particular embodiment, there can be four first through holes 222' in the base 2', and the central distance of any two adjoin first through holes 222' can be selected 32 mm. Therefore, the central distance of the two first through holes 222' at the end is 96 mm, and the central distance of the two odd or even first through holes 222' is 64 mm so that the base 2' can use for a cabinet with 32 mm, 64 mm, or 96 mm hole central distance.

Similarly, in the aforesaid embodiment, the through holes 23 in the base 2 are compatible with 32 mm-furniture-system.

Accordingly, a lighting structure is provided in the present invention, and the present invention has been described in detail. However, the above descriptions are only provided as preferred embodiments of the present invention rather than to limit the scope of the present invention. Therefore, equivalent changes and modifications made within the spirit of the present invention shall still fall within the scope claimed in the following claims as appended.

The invention claimed is:

1. A lighting structure, being a light source device adapted to be installed on a structural object, the lighting structure comprising:

a body comprising a first engagement portion;

a base comprising a second engagement portion and structures installed on the structural object, wherein the second engagement portion is a structure that matches the first engagement portion so that the second engagement portion and the first engagement portion are allowed to engage with or disengage from each other;

at least one lamp being disposed in the body to emit light; and an electrical circuit being disposed in the body and comprising a vibration sensing element, a control element and an electric power supplying portion, the vibration sensing element being adapted to output a corresponding electrical signal to the control element when being vibrated, the control element being adapted to choose to turn on or turn off the at least one lamp of the electrical circuit correspondingly when receiving the electrical signal from the vibration sensing element, and the electric power supplying portion being adapted to provide electric power necessary for operation of the electrical circuit;

wherein the body is disposed on the base through engagement of the first engagement portion and the second engagement portion.

2. The lighting structure of claim 1, wherein the body is a cuboid structure and comprises a first space and a second space therein, the vibration sensing element and the control element in the electrical circuit being disposed in the first space, the electric power supplying portion in the electrical circuit being disposed in the second space, and at least one lamp hole extending through the body outwards from the first space being formed corresponding to the at least one lamp so that light of the at least one lamp is emitted from the corresponding lamp hole.

3. The lighting structure of claim 2, wherein the body further comprises a front cover and a rear cover, the front cover and the rear cover each being a hollow shell, the front cover having an opening extending through an interior hollow portion thereof at a rear end thereof, the rear cover having an opening extending through a hollow portion at a front end and a rear end thereof respectively, the rear cover comprising a partition for dividing the interior hollow portion thereof, the first space being formed by a space surrounded by the rear end of the front cover and the front end of the rear cover, the first space being adapted to accommodate the electrical circuit, the second space being formed in the rear end of the rear cover, the second space further including a battery holder adapted to accommodate a plurality of batteries and electrically connected to the electrical circuit, and the batteries disposed in the battery holder supplying electric power necessary for the electrical circuit.

4. The lighting structure of claim 3, wherein the electrical circuit further comprises a circuit board disposed in the body, and the vibration sensing element and the control element are disposed on the circuit board.

5. The lighting structure of claim 4, wherein the opening of the rear end of the front cover comprises a plurality of through-mortises at a periphery thereof, the opening of the front end of the rear cover comprises a plurality of tenons corresponding to the mortises at a periphery thereof, the mortises being through holes extending through a wall, the tenons being flanges protruding from a surface, and the tenons being snap-fitted into the corresponding mortises respectively to join the front cover to the rear cover; the opening of the front end of the rear cover comprises a support portion at the periphery thereof, the support portion has an outside diameter smaller than an inside diameter of the opening of the rear end of the front cover, the tenons being flanges protruding from a surface around the support portion, the support portion being adapted to be engaged into the opening of the rear end of the front cover, and the tenons corresponding to the mortises in the front cover to join the front cover to the rear cover; the support portion of the rear cover at least comprises a first end surface and a second end surface, and the first end surface extends in a direction of the opening of the front end of the rear cover to a distance longer than a distance to which the second end surface extends in the direction of the opening of the front end of the rear cover so that the front surface comprising the at least one lamp of the circuit board is formed to be inclined; and the circuit board accommodated in the first space is disposed on an end surface of the support portion, and the at least one lamp is disposed on a front surface of the circuit board and correspond to each of the lamp holes of the body, respectively.

6. The lighting structure of claim 4, wherein the circuit board comprises two conductive portions therein, which serve as a positive-electrode conductor and a negative-electrode conductor for electric power input of the circuit board, respectively, and are electrically connected to positions corresponding to a positive electrode and a negative electrode of the batteries of the battery holder; the partition of the rear cover comprises two apertures therein corresponding to the conductive portions in the circuit board, respectively, in which the conductive portions in the circuit board extends from the circuit board through the corresponding apertures into the battery holder of the rear cover, and the battery holder accommodates a plurality of batteries and is electrically connected to the circuit board; and the conductive portions in the circuit board are each an electrical conductor made of a copper sheet.

7. The lighting structure of claim 3, wherein a side of the opening of the rear end of the rear cover comprises a plurality of barbs corresponding to the battery holder, and in a status where the battery holder is installed with batteries, the barbs fasten the batteries into the battery holder; and the barbs are each an elastic plate formed by extending upwards from a side edge of the bottom surface of the battery holder, and the barbs are adapted to provide a lateral elastic force respectively, in which each of the barbs has a top end which is an arc-shaped flange extending parallel to the opening of the rear end of the rear cover, respectively.

8. The lighting structure of claim 2, wherein the second space is further formed with a battery holder, the battery holder being adapted to accommodate a plurality of batteries and being electrically connected to the electrical circuit, the batteries disposed in the battery holder supplying electric power necessary for the electrical circuit, and the battery holder of the body comprising an opening formed by extending outwards from the second space; the base is an L-shaped body and comprises a base plate and a back plate, the back plate of the base having a length corresponding to a length of the body, and the base plate having a rear end extending upwards to form the back plate, and the back plate corresponding to a back surface of the body; and the back plate of the base corresponds to the back surface of the body and covers the opening of the second space of the body.

9. The lighting structure of claim 8, wherein the base plate of the base at least comprises two through holes, which is formed by extending downwards from an upper surface of the base plate and adapted for a screw to be inserted therethrough; and the through holes in the base are compatible with 32 mm-furniture-system.

10. The lighting structure of claim 1, further comprising a fixing mount and a bolt, the fixing mount being formed on the bottom of the base, the fixing mount comprising a front gripping portion and a rear gripping portion, the front gripping portion and the rear gripping portion being two plate structures opposite to each other, the rear gripping portion comprising a screw hole extending through the rear gripping portion along an anterior-posterior direction of the rear gripping portion, the bolt being threaded into the screw hole of the rear gripping portion, and the bolt limiting a space between an inner surface of the front gripping portion and a front end edge of the bolt.

11. The lighting structure of claim 10, further comprising a screw, wherein a top end of the fixing mount further comprises at least one screw hole, and the base comprises a through hole corresponding to the screw hole, so that the screw is threaded through the through hole of the base into the screw hole of the fixing mount to lock the fixing mount to the bottom of the base.

12. The lighting structure of claim 10, wherein the top end of the fixing mount further comprises a plurality of convex portions, and a lower surface of the base plate of the base comprises a plurality of corresponding concave portions, the convex portions being structures protruding from a top end surface of the fixing mount, the concave portions being concave structures in a bottom end surface of the base plate, and each of the concave portions corresponding to a convex portion respectively and being adapted to engage with the corresponding convex portion.

13. The lighting structure of claim 1, wherein the first engagement portion in the body comprises at least one iron plate, which is a sheet disposed on the bottom surface of the body and is configured to be attracted by a magnet, and the second engagement portion in the base a magnet corresponding to the iron plate, which is disposed in the base and corresponds to the iron plate.

14. The lighting structure of claim 13, wherein the base further comprises a double sided tape adhered to a lower surface of the base.

15. The lighting structure of claim 1, wherein the first engagement portion comprises at least one concave hole which is a concave structure formed by extending upwards from the bottom of the body, and the second engagement portion comprises a convex plate corresponding to the concave hole of the first engagement portion, the convex plate of the second engagement portion being a convex structure formed by extending upwards from the base plate of the base, and the concave hole of the first engagement portion and the convex plate of the second engagement portion being allowed to engage with and disengage from each other.

16. The lighting structure of claim 1, wherein when the at least one lamp of the electrical circuit is in the turn-off status and the vibration sensing element is vibrated to output the electrical signal, the control element chooses to turn on the at least one lamp correspondingly, and when the lamp of the electrical circuit is in the turn-on status and the vibration sensing element is vibrated to output the electrical signal, the control element chooses to turn off the at least one lamp correspondingly.

17. The lighting structure of claim 1, wherein the control element further provides a logic control function so that when receiving the electrical signal from the vibration sensing element, the control element chooses to turn on the at least one lamp correspondingly, and after a time preset in the control element, chooses to turn off the at least one lamp.

18. The lighting structure of claim 1, wherein the electric power supplying portion is a device that is externally connected to a power source.

19. The lighting structure of claim 1, wherein the electric power supplying portion is a device having a built-in power source, and the built-in power source is one of a battery, a secondary battery and a device capable of regenerating electric power.

20. The lighting structure of claim 1, wherein the base comprises a back plate, a first bevel portion and a second bevel portion, the first bevel portion being formed on the rear surface of the back plate, the first bevel portion and the rear surface of the back plate forming an inclination angle, the first bevel portion having a first through hole therein, the second bevel portion being formed on the rear surface of the back plate, the second bevel portion and the rear surface of the back plate forming another inclination angle, the second bevel portion having a second through hole therein, and the first bevel portion and the second bevel portion having different surface directions.

21. The lighting structure of claim 20, wherein the second engagement portion is an L-shaped structure formed by extending the bottom of the back plate of the base forwards to an appropriate distance and then upwards.

22. The lighting structure of claim 1, wherein the base comprises a back plate, a first bevel portion and a second bevel portion, the first bevel portion being formed on the rear surface of the back plate, the first bevel portion and the rear surface of the back plate forming an inclination angle, the first bevel portion having a double sided tape thereon, the second bevel portion being formed on the rear surface of the back plate, the second bevel portion and the rear surface of the back plate forming another inclination angle, the second bevel portion having another double sided tape thereon, and the first bevel portion and the second bevel portion having different surface directions.

23. The lighting structure of claim 22, wherein the second engagement portion is an L-shaped structure formed by extending the bottom of the back plate of the base forwards to an appropriate distance and then upwards.

24. The lighting structure of claim 1, wherein the base comprises a back plate, a first bevel portion and a second bevel portion, the first bevel portion being formed on the rear surface of the back plate, the first bevel portion and the rear surface of the back plate forming an inclination angle, the first bevel portion having a magnet thereon, the second bevel portion being formed on the rear surface of the back plate, the second bevel portion and the rear surface of the back plate forming another inclination angle, the second bevel portion having another magnet thereon, and the first bevel portion and the second bevel portion having different surface directions.

25. The lighting structure of claim 24, wherein the second engagement portion is an L-shaped structure formed by extending the bottom of the back plate of the base forwards to an appropriate distance and then upwards.

26. The lighting structure of claim 1, wherein the base at least comprises two through holes of which each is for a screw to be inserted therethrough; and the through holes in the base are compatible with 32 mm-furniture-system.

* * * * *